US005605058A

United States Patent [19]

Kurachi et al.

[11] Patent Number: 5,605,058

[45] Date of Patent: Feb. 25, 1997

[54] AIR CONDITIONING SYSTEM, AND ACCUMULATOR THEREFOR AND MANUFACTURING METHOD OF THE ACCUMULATOR

[75] Inventors: Mitsunori Kurachi; Masahiko Sugino; Tomohiko Kasai; Hirofumi Kouge; Tatsuo Ono, all of Wakayama; Masaharu Moriyasu, Hyogo; Youichi Hisamori, Hyogo; Kenji Kawaguchi, Hyogo; Michio Fujiwara, Hyogo, all of Japan

[73] Assignee: Mitsubishi Denki Kabushiki Kaisha, Tokyo, Japan

[21] Appl. No.: 404,463

[22] Filed: Mar. 15, 1995

[30] Foreign Application Priority Data

| | | | |
|---|---|---|---|
| Mar. 15, 1994 | [JP] | Japan | 6-043999 |
| Jul. 28, 1994 | [JP] | Japan | 6-176928 |
| Oct. 6, 1994 | [JP] | Japan | 6-242676 |

[51] Int. Cl.[6] ..... F25B 43/00

[52] U.S. Cl. ..... 62/503; 62/193; 62/470

[58] Field of Search ..... 62/503, 509, 470, 62/471, 472, 473, 192, 193

[56] References Cited

U.S. PATENT DOCUMENTS

| | | | |
|---|---|---|---|
| 4,557,115 | 12/1985 | Nakamura | 62/503 X |
| 4,646,527 | 3/1987 | Taylor | 62/503 X |
| 4,912,937 | 4/1990 | Nakamura et al. | 62/470 X |

FOREIGN PATENT DOCUMENTS

| | | |
|---|---|---|
| 63-38865 | 2/1988 | Japan . |
| 1273955 | 11/1989 | Japan . |
| 62957 | 1/1994 | Japan . |

*Primary Examiner*—Harry B. Tanner

*Attorney, Agent, or Firm*—Oblon, Spivak, McClelland, Maier & Neustadt, P.C.

[57] ABSTRACT

An air conditioning system of the present invention has a refrigerant circuit including a compressor, an oil separator, a condenser, a expansion device, an evaporator, a first accumulator, and a second accumulator which are connected in order by piping, said evaporator, said first accumulator, said second accumulator, and said compressor being connected in series; a first oil return bypass for connecting said oil separator and a connection pipe between said first and second accumulators; and a second oil return bypass for connecting said first accumulator and a connection pipe between said second accumulator and said compressor.

38 Claims, 30 Drawing Sheets

AIR CONDITIONING SYSTEM, AND ACCUMULATOR THEREFOR AND MANUFACTURING METHOD OF THE ACCUMULATOR

BACKGROUND OF THE INVENTION

1. Field of the Invention

This invention relates to an oil return function of an air conditioning system, including a compressor, an oil separator, a condenser, a expansion device, an evaporator, and accumulators connected to each other by piping, and the accumulator used with the refrigerant circuit and a method for manufacturing the accumulator.

2. Description of the Conventional Art

FIG. 41 shows a refrigerant circuit of a conventional air conditioning system, wherein numeral 1 is a compressor, numeral 2 is an oil separator, numeral 3 is a heat source machine heat exchanger serving as a condenser at the time, numeral 4 is a expansion device, numeral 5 is an indoor heat exchanger serving as an evaporator at the time, numeral 6 is a first accumulator, numeral 7 is a second accumulator, numeral 8 is a connection pipe for connecting the first and second accumulators 6 and 7, numeral 9 is a connection pipe for connecting the second accumulator 7 and the compressor 1, numeral 10 is an oil return bypass for connecting the oil separator 2 and the connection pipe 8, numeral 11 is an oil return device disposed at a midpoint in the pipe of the oil return bypass 10, numeral 12 is an oil return bypass for connecting the bottom of the first accumulator 6 and the connection pipe 8, numeral 13 is an oil return device disposed at a midpoint in the pipe of the oil return bypass 12, numeral 14 is a U effluent pipe of the second accumulator 7 connected to the connection pipe 9, numeral 15 is an oil return hole disposed at a midpoint in the U effluent pipe 14, and numeral 20 is a fluid pipe for connecting the heat source machine heat exchanger 3 and the expansion device 4.

Next, flows of a refrigerant and oil will be discussed. The high-temperature and high-pressure gas refrigerant discharged from the compressor 1 flows into the oil separator 2, which then separates oil therefrom. The gas refrigerant flows into the heat source machine heat exchanger 3, which exchanges heat between the gas refrigerant and air, water, etc., and condenses and liquefies the gas refrigerant. The liquid refrigerant flows through the fluid pipe 20 to the expansion device 4, through which the refrigerant becomes a low-pressure vapor-liquid two-phase condition and flows into the indoor heat exchanger 5, which then exchanges heat between the refrigerant and air, water, etc. As a result, the refrigerant becomes gas or a vapor-liquid two-phase condition at large dryness and returns via the first accumulator 6, connection pipe 8, second accumulator 7, and connection pipe 9 to the compressor 1. On the other hand, the oil separated by the oil separator 2 flows via the oil return device 11 and oil return bypass 10 to the connection pipe 8, then flows into the second accumulator 7. Since separation of the oil from the refrigerant at the oil separator 2 is not complete, oil together with the liquid refrigerant accumulates in the first accumulator 6. The oil and liquid refrigerant flow via the oil return device 13 and the oil return bypass 12 into the connection pipe 8, then flows into the second accumulator 7. The oil and liquid refrigerant accumulated in the second accumulator 7 flows through the oil return hole 15 to the U effluent pipe 14 and returns to the compressor 1.

Here, the oil and liquid refrigerant accumulated in the first accumulator 6 flows through the oil return bypass 12 to the connection pipe 8 because the total pressure difference of the dynamic pressure difference between the inside of the connection pipe 8 and the inside of the first accumulator 6, the differential pressure produced due to the friction loss of the gas refrigerant flowing through the connection pipe 8, and the liquid head produced according to the liquid level of the first accumulator 6 occurs across the oil return device 13. Likewise, the oil and liquid refrigerant accumulated in the second accumulator 7 flows to the U effluent pipe 14 because the total pressure difference of the dynamic pressure difference between the inside of the U effluent pipe 14 and the inside of the second accumulator 7, the differential pressure produced due to the friction loss of the gas refrigerant flowing through the U effluent pipe 14, and the liquid head produced according to the liquid level of the second accumulator 7 occurs across the oil return hole 15.

Generally, if an excess refrigerant is accumulated in the first accumulator 6 in large quantity, the oil separated by the oil separator 2 flows into the first accumulator 6 and is diluted with the liquid refrigerant in the first accumulator 6 and the oil return from the first accumulator 6 to the second accumulator 7 is delayed, causing oil exhaustion in the compressor 1. However, this does not occur even if an excess refrigerant is accumulated in the first accumulator 6 in large quantity, because the oil return bypass 10 is connected to the connection pipe 8. The oil separated by the oil separator 2 promptly returns via the second accumulator 7 to the compressor 1, providing a sufficient amount of oil in the compressor 1.

When the system is started in the condition in which the compressor 1 stops for a long time and a liquid refrigerant is allowed to stand in the shell of the compressor 1, the liquid refrigerant and oil in the shell are discharged in large quantity. The oil separator 2 traps the liquid refrigerant and oil, inhibiting efflux of a large amount of oil to the heat source machine heat exchanger 3, etc. Since the oil return bypass 10 is connected to the connection pipe 8, a large amount of the liquid refrigerant trapped in the oil separator 2 once flows into the second accumulator 7 without directly returning to the compressor 1 and returns through the oil return hole 15 to the compressor 1 little by little. Thus, damage to the compressor 1 caused by a rapid back flow of fluid can be inhibited. Generally, if an excess refrigerant is accumulated in the first accumulator 6 in large quantity, the oil together with the liquid refrigerant trapped in the oil separator 2 flows into the first accumulator 6 and is diluted with the liquid refrigerant in the first accumulator 6 and the oil return from the first accumulator 6 to the second accumulator 7 is delayed, causing oil exhaustion in the compressor 1. However, this can be suppressed even if an excess refrigerant is accumulated in the first accumulator 6 in large quantity, because the oil return bypass 10 is connected to the connection pipe 8.

Since the refrigerant circuit of the conventional air conditioning system is thus configured, the connection pipe 8 has large flow path resistance for causing the oil and liquid refrigerant accumulated in the first accumulator 6 to flow through the oil return device 13 into tile connection pipe 8, the U effluent pipe 14 has large flow path resistance for causing the oil and liquid refrigerant accumulated in the second accumulator 7 to flow through the oil return hole 15 into the U effluent pipe 14, and the pressure loss from the indoor heat exchanger 5 to tile compressor 1 is large and the refrigeration capability cannot sufficiently be exhibited because the liquid refrigerant passes through the first and second accumulators 6 and 7 in series.

The occupation space required for the first accumulator 6, the second accumulator 7, and the connection pipe 8 is large and a large number of points are brazed, reliability being lacked.

In addition, the conventional accumulator will be described as follows.

Next, FIGS. 42A and 42B show the structures of the conventional accumulators. The first accumulator 6 is a large pressure tank and the second accumulator 7 is a pressure vessel smaller than the first accumulator 6. The connection pipe 8 connecting the first and second accumulators 6 and 7 is a pipe thus bent because the oil return bypass 10 is connected to the upper side and the oil return bypass 12 to the lower side. Shown in the figure are the connection pipe 9 for connecting the second accumulator 7 and the compressor 1, the oil return bypass for connecting the bottom of the first accumulator 6 and the connection pipe 8, the oil return device disposed at a midpoint in the pipe of the oil return bypass 12, the U-effluent pipe of the second accumulator 7 connected to the connection pipe 9, and the oil return hole formed at a midpoint in the U-effluent pipe 14. Numeral 16 is an upper liquid level detector and numeral 17 is a lower liquid level detector. Since the conventional refrigerant circuit accumulators are thus configured, the liquid refrigerant passes through the first and second accumulators 6 and 7 in series. Therefore, the pressure loss from the evaporator 5 to the compressor 1 is large and the refrigeration capability cannot sufficiently be exhibited. The space occupied by the first accumulator 6, the second accumulator 7, and the connection pipe 8 is large, the long connection pipe 8 is required, and two pressure vessels are also required, thus the manufacturing costs are high. Further, a large number of points are brazed and reliability is lacked.

SUMMARY OF THE INVENTION

It is therefore an object of the present invention to provide exhibiting a sufficient refrigerant capability with a small pressure loss from an evaporator to a compressor and having sufficient reliability with a small number of connection points by brazing or the like, although having a small space occupied by an accumulator and the like.

It is another object of the present invention to provide a refrigerant circuit accumulator which has a sufficient vapor and liquid separation feature, an oil return feature and a fluid backflow inhibition feature, wherein the pressure loss particularly when refrigerant passes through first and second accumulator chambers is small so as to decrease the pressure loss from an evaporator to a compressor.

In order to achieve the above object, an air conditioning system of the present invention is comprised of a refrigerant circuit including a compressor, an oil separator, a condenser, a expansion device, an evaporator, a first accumulator, and a second accumulator which are connected in order by piping, the evaporator, the first accumulator, the second accumulator, and the compressor being connected in series; a first oil return bypass for connecting the oil separator and a connection pipe between the first and second accumulators; and a second oil return bypass for connecting the first accumulator and a connection pipe between the second accumulator and the compressor.

In order to achieve another object, an accumulator used with a refrigerant circuit including a compressor, an oil separator, a condenser, a expansion device, an evaporator, and an accumulator connected by piping, is comprised of a partition plate provided in a vessel of the accumulator to separate the vessel into first and second chambers; a communication hole provided at a top of the partition plate; a refrigerant inflow pipe disposed in the first chamber; a refrigerant effluent pipe disposed in at least one of the first and second chambers; and an oil effluent pipe and an oil inflow pipe which are disposed in the second chamber.

In the above air conditioning system of the present invention, the oil and liquid refrigerant accumulated in the first accumulator return from the first accumulator through the second oil return bypass to the connection pipe connecting the second accumulator and the compressor. Therefore, the pressure loss at the connection pipe connecting the first and second accumulators is small. Since the oil and liquid refrigerant to be returned from the second accumulator to the compressor may be only the amount of those flowing into the second accumulator from the oil separator (the oil and liquid refrigerant accumulated in the first accumulator return directly to the compressor without passing through the second accumulator), the pressure loss at the connection pipe connecting the second accumulator and the compressor can be lessened.

In the above accumulator of the present invention, the accumulator configured as described above provides a similar function to that of two accumulators; it separates refrigerant into vapor and liquid, stores refrigerant, and returns liquid refrigerant at high oil concentration to the compressor. At the time, the pressure loss of gas refrigerant passing through the accumulator lessens as compared with the conventional accumulators, and the accumulator installation space also reduces.

PREFERRED EMBODIMENT OF THE INVENTION

Referring now to the accompanying drawings, preferred embodiments of the present invention will be described as follows.

First, the embodiments with respect to a refrigerant circuit of an air conditioning system of the present invention will be described.

Figure 1:
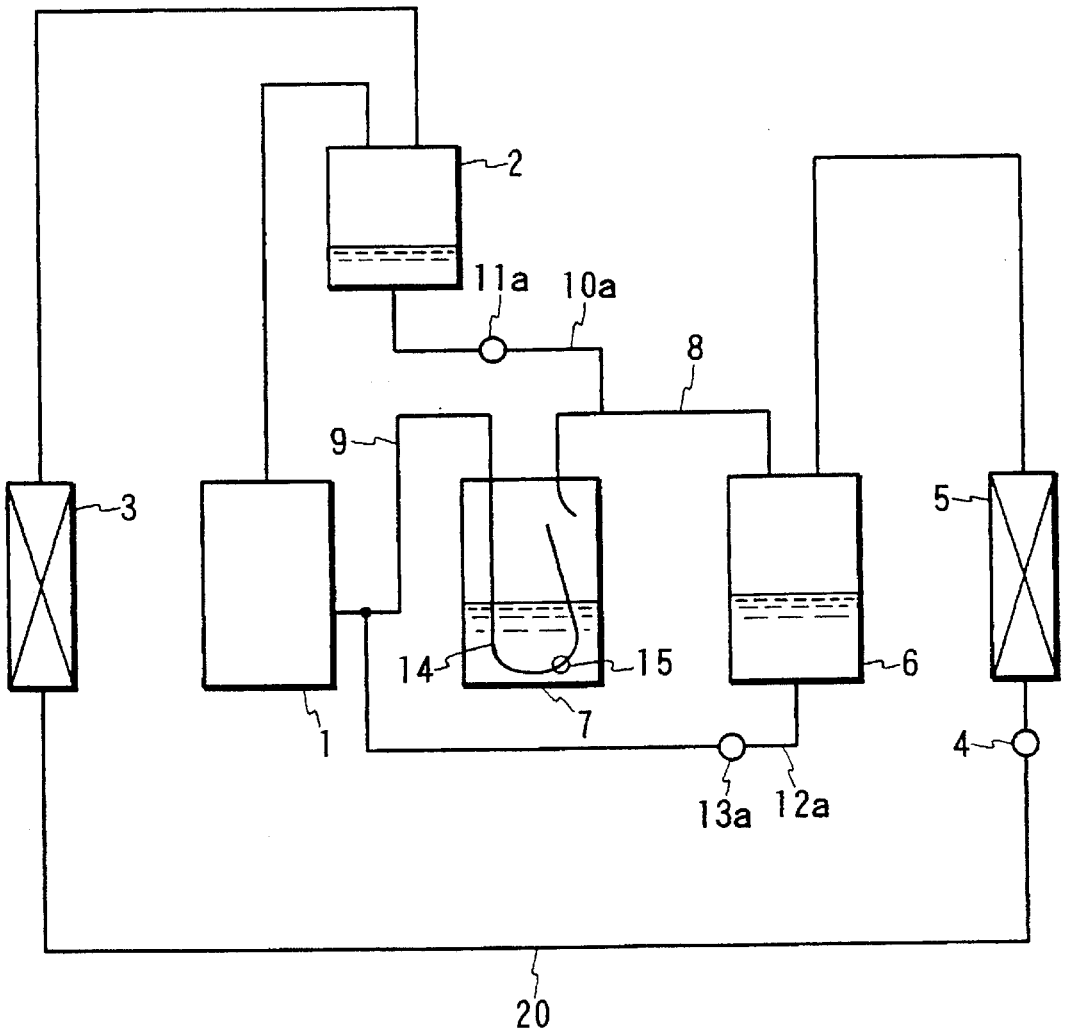
FIG. 1 is a refrigerant circuit diagram of an air conditioning system according to embodiment 1 of the invention.

Embodiment 1:

FIG. 1 is a refrigerant circuit diagram of an air conditioning system according to the first embodiment of the invention. In the figure, numerals 1 to 9, 14, and 15 are identical with or similar to the refrigerant circuit of the conventional air conditioning system described with reference to FIG. 41, and therefore will not be discussed again.

Numeral 10*a* is a first oil return bypass for connecting an oil separator 2 and a connection pipe 8 and numeral 11*a* is a first oil return device disposed at a pipe midpoint of the first oil return bypass 10*a*. Numeral 12*a* is a second oil return bypass for connecting the bottom of a first accumulator 6 and a connection pipe 9 and numeral 13*a* is a second oil return device disposed at a pipe midpoint of the second oil return bypass 12*a*.

Flows of a refrigerant and oil are the same as those in the refrigerant circuit of the conventional air conditioning system except the return flow of oil and liquid refrigerant from first and second accumulators 6 and 7, and therefore will not be discussed again. The oil and liquid refrigerant accumulated in the first accumulator 6 flows via the second oil return device 13*a* and the second oil return bypass 12*a* to the connection pipe 9, then returns to a compressor 1. On the other hand, the oil and liquid refrigerant accumulated in the second accumulator 7 flows through an oil return hole 15 to a U effluent pipe 14 and returns via the connection pipe 9 to the compressor 1.

Generally, if an excess refrigerant is accumulated in the first accumulator 6 in large quantity, the oil separated by the oil separator 2 flows into the first accumulator 6 and is diluted with the liquid refrigerant in the first accumulator 6 and the oil return from the first accumulator 6 to the second accumulator 7 is delayed, causing oil exhaustion in the compressor 1. However, this does not occur when if an excess refrigerant is accumulated in the first accumulator 6 in large quantity, because the first oil return bypass 10*a* is connected to the connection pipe 8. The oil separated by the oil separator 2 promptly returns via the second accumulator 7 to the compressor 1, providing a sufficient amount of oil in the compressor 1.

When the system is started in the condition in which the compressor 1 stops for a long time and a liquid refrigerant is allowed to stand in the shell of the compressor 1, the liquid refrigerant and oil in the shell are discharged in large quantity. The oil separator 2 traps the liquid refrigerant and oil, inhibiting efflux of a large amount of oil to a heat source machine heat exchanger 3, etc. Since the first oil return bypass 10*a* is connected to the connection pipe 8, a large amount of the liquid refrigerant trapped in the oil separator 2 once flows into the second accumulator 7 without directly returning to the compressor 1 and returns through the oil return hole 15 to the compressor 1 little by little. Thus, damage to the compressor 1 caused by a rapid back flow of fluid can be inhibited. Generally, if an excess refrigerant is accumulated in the first accumulator 6 in large quantity, the oil together with the liquid refrigerant trapped in the oil separator 2 flows into the first accumulator 6 and is diluted with the liquid refrigerant in the first accumulator 6 and the oil return from the first accumulator 6 to the second accumulator 7 is delayed, causing oil exhaustion in the compressor 1. However, this can be suppressed even if an excess refrigerant is accumulated in the first accumulator 6 in large quantity, because the first oil return bypass 10*a* is connected to the connection pipe 8.

Here, the oil and liquid refrigerant accumulated in the first accumulator 6 flows through the second oil return bypass 12*a* to the connection pipe 9 because the total pressure difference of the dynamic pressure difference between the inside of the connection pipe 9 and the inside of the first accumulator 6, the differential pressure produced due to the friction loss of the gas refrigerant flowing through the connection pipe 8, the second accumulator 7, and the connection pipe 9, and the liquid head produced according to the liquid level of the first accumulator 6 occurs across the second oil return device 13*a*. Therefore, the flow path resistance of the connection pipe 8 can be lessened as compared with the refrigerant circuit of the conventional air conditioning system shown in FIG. 41.

Since oil and liquid refrigerant do not flow into the second accumulator 7 from the first accumulator 6, small amounts of oil and liquid refrigerant are returned through the oil return hole 15. Therefore, the pressure difference which should occur across the oil return hole 15 may be smaller than that in the refrigerant circuit of the conventional air conditioning system shown in FIG. 41. That is, the flow path resistance of the U effluent pipe 14 can be lessened.

Thus, the pressure loss from the indoor heat exchanger 5 to the compressor 1 can be lessened while the original oil return function and fluid back flow inhibition function are provided; an air conditioning system exhibiting a sufficient refrigeration capability can be provided.

Figure 2:
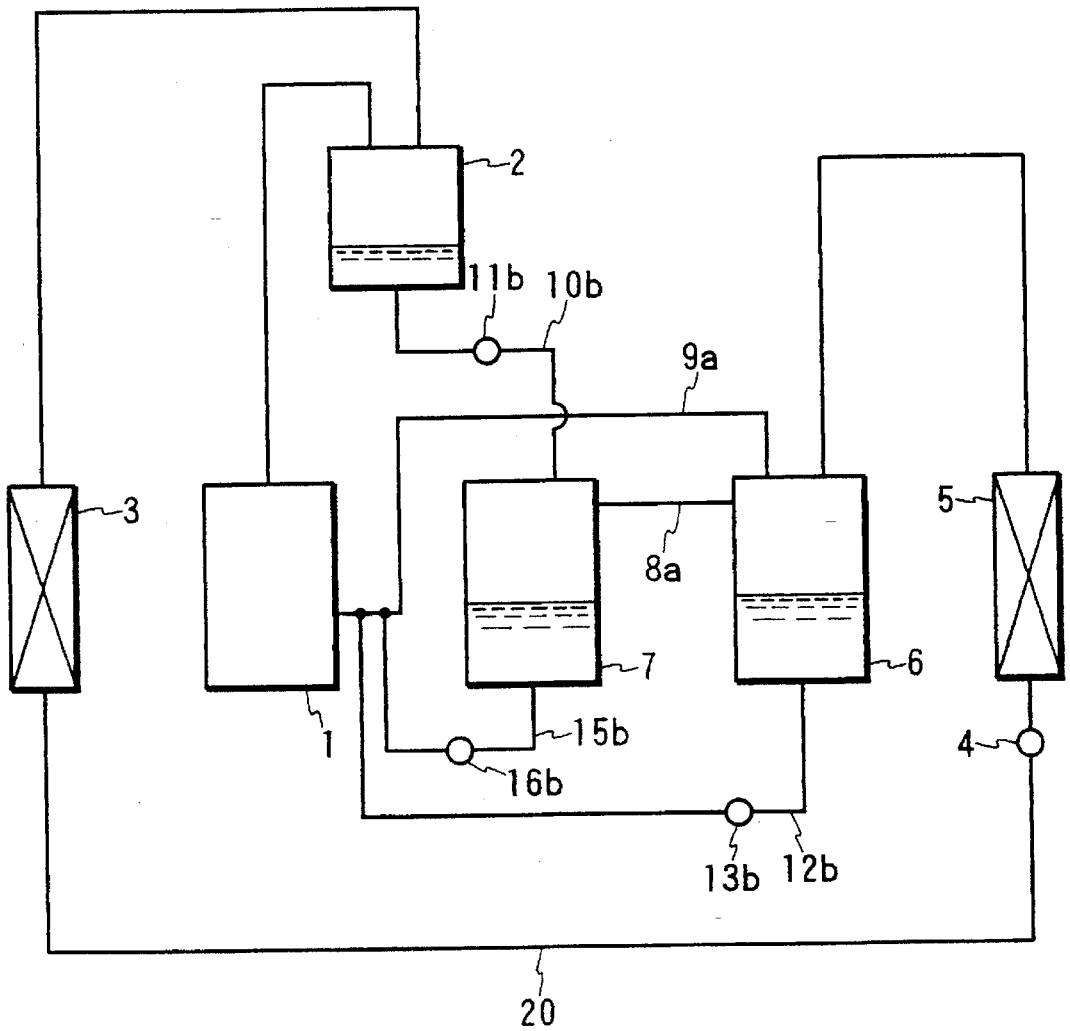
FIG. 2 is a refrigerant circuit diagram of an air conditioning system according to embodiment 2 of the invention.

Embodiment 2:

FIG. 2 is a refrigerant circuit diagram of an air conditioning system according to the second embodiment of the invention. In the figure, numerals 1 to 7 are identical with or similar to those the refrigerant circuit of the air conditioning system according to the first embodiment described with reference to FIG. 1, and therefore will not be discussed again. Numeral 8*a* is a connection pipe for connecting the side top of a first accumulator 6 and the side top of a second accumulator 7, numeral 9*a* is a connection pipe for connecting the first accumulator 6 and a compressor 1, numeral 10*b* is a third oil return bypass for connecting an oil separator 2 and the second accumulator 7, numeral 11*b* is a third oil return device disposed at a pipe midpoint of the third oil return bypass 10*b*, numeral 15*b* is a fifth oil return bypass for connecting the bottom of the second accumulator 7 and the connection pipe 9*a*, numeral 16*b* is a fifth oil return device disposed at a pipe midpoint of the fifth oil return bypass 15*b*, numeral 12*b* is a fourth oil return bypass for connecting the bottom of the first accumulator 6 and the connection pipe 9*a*, and numeral 13*b* is a fourth oil return device disposed at a pipe midpoint of the fourth oil return bypass 12*b*.

Next, flows of a refrigerant and oil will be discussed. The flow from the compressor 1 to indoor heat exchanger 5 is the same as that in the refrigerant circuit of the air conditioning system according to embodiment 1 and therefore will not be discussed again. The refrigerant flowing out of the indoor heat exchanger 5 returns via the first accumulator 6 and the connection pipe 9*a* to the compressor 1. That is, it passes through only the first accumulator 6 between the indoor heat exchanger 5 and the compressor 1, so that the pressure loss from the indoor heat exchanger 5 to the compressor 1 lessens. On the other hand, the oil separated by the oil separator 2 flows via the third oil return device 11*b* and the third oil return bypass 10*b* into the second accumulator 7. Since separation of the oil from the refrigerant at the oil separator 2 is not complete, oil together with the liquid refrigerant accumulates in the first accumulator 6. The oil and liquid refrigerant flow via the fourth oil return device 13*b* and the fourth oil return bypass 12*b* into the connection pipe 9*a* and returns to the compressor 1. The oil and liquid refrigerant accumulated in the second accumulator 7 return via the fifth oil return device 16*b* and the fifth oil return bypass 15*b* to the compressor 1.

Generally, if an excess refrigerant is accumulated in the first accumulator 6 in large quantity, the oil separated by the oil separator 2 flows into the first accumulator 6 and is diluted with the liquid refrigerant in the first accumulator 6 and the oil return from the first accumulator 6 to the second accumulator 7 is delayed, causing oil exhaustion in the compressor 1. However, this does not occur even if an excess refrigerant is accumulated in the first accumulator 6 in large quantity, because the third oil return bypass 10*b* is connected to the second accumulator 7. The oil separated by the oil separator 2 promptly returns via the second accumulator 7 to the compressor 1, providing a sufficient amount of oil in the compressor 1.

When the system is started in the condition in which the compressor 1 stops for a long time and a liquid refrigerant is allowed to stand in the shell of the compressor 1, the liquid refrigerant and oil in the shell are discharged in large quantity. The oil separator 2 traps the liquid refrigerant and oil, inhibiting efflux of a large amount of oil to a heat source machine heat exchanger 3, etc. Since the third oil return bypass 10*b* is connected to the second accumulator 7, a large amount of the liquid refrigerant trapped in the oil separator 2 once flows into the second accumulator 7 without directly returning to the compressor 1 and returns through the fifth oil return device 16*b* to the compressor 1 little by little. Thus, damage to the compressor 1 caused by a rapid back flow of fluid can be inhibited. Generally, if an excess refrigerant is accumulated in the first accumulator 6 in large quantity, the oil together with the liquid refrigerant trapped in the oil separator 2 flows into the first accumulator 6 and is diluted with the liquid refrigerant in the first accumulator 6 and the oil return from the first accumulator 6 to the second accumulator 7 is delayed, causing oil exhaustion in the compressor 1. However, this can be suppressed even if an excess refrigerant is accumulated in the first accumulator 6 in large quantity, because the third oil return bypass 10*b* is connected to the second accumulator 7.

Thus, the pressure loss from the indoor heat exchanger 5 to the compressor 1 can be lessened while the original oil return function and fluid back flow inhibition function are provided; an air conditioning system exhibiting a sufficient refrigeration capability can be provided.

Figure 3:
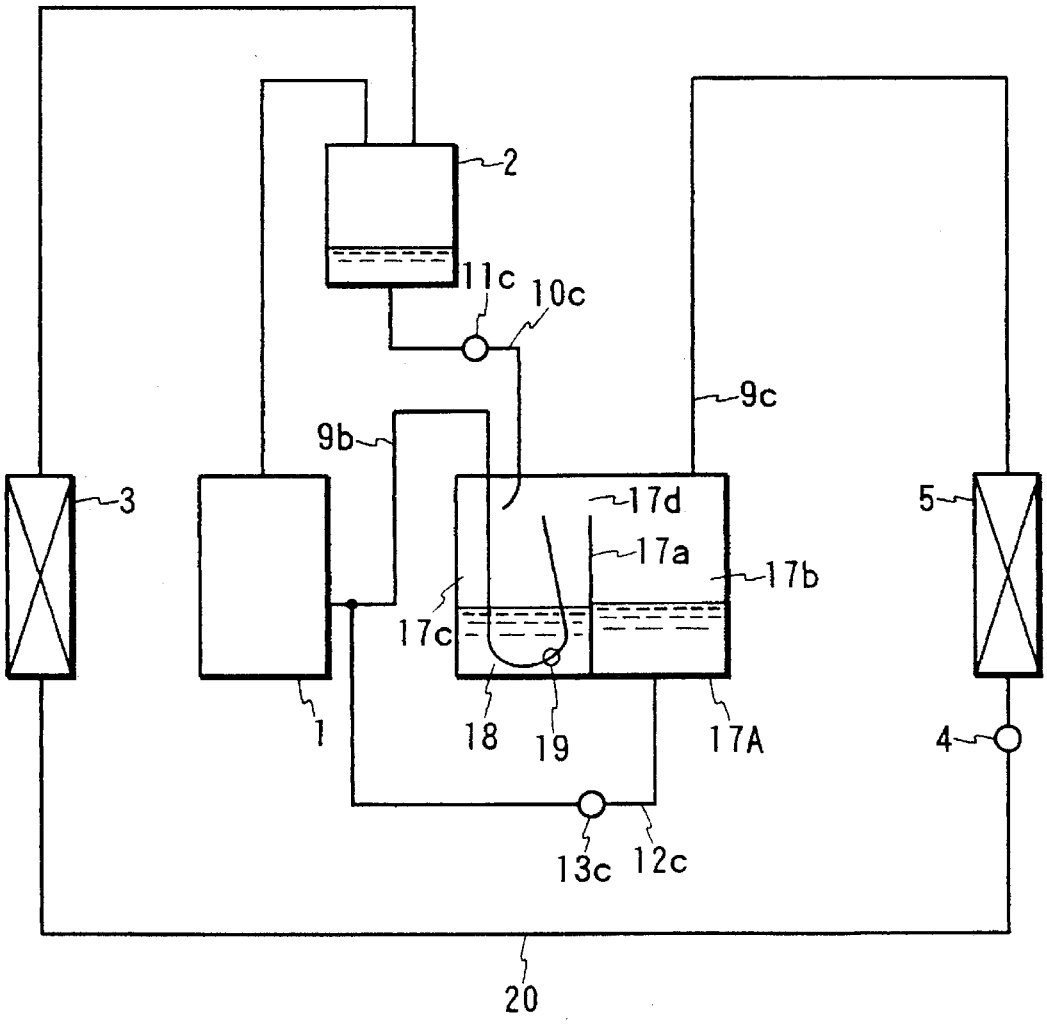
FIG. 3 is a refrigerant circuit diagram of an air conditioning system according to embodiment 3 of the invention.

Embodiment 3:

FIG. 3 is a refrigerant circuit diagram of an air conditioning system according to the third embodiment of the invention. In the figure, numerals 1 to 5 are identical with or similar to those of the refrigerant circuit of the air conditioning system according to the first embodiment described with reference to FIG. 1, and therefore will not be discussed again. Numeral 17A is an accumulator, numeral 9*b* is a connection pipe flowing out of the accumulator 17A and flowing into a compressor 1, numeral 9*c* is an inflow pipe flowing into the accumulator 17A from an indoor heat exchanger 5, numeral 17*a* is a partition plate for separating the inside of the accumulator 17A into two chambers, numeral 17*b* is a first chamber of the accumulator 17A separated by the partition plate 17*a*, numeral 17*c* is a second chamber of the accumulator 17A separated by the partition plate 17*a*, numeral 12*c* is a seventh oil return bypass for connecting the bottom of the first chamber 17*b* of the accumulator 17A and the connection pipe 9*b*, numeral 13*c* is a seventh oil return device disposed at a pipe midpoint of the seventh oil return bypass 12*c*, numeral 18 is a U-effluent pipe connected to the connection pipe 9*b* from the inside of the second chamber 17*c* of the accumulator 17A, numeral 19 is an oil return hole disposed in the U-effluent pipe 18, numeral 10*c* is a sixth oil return bypass for connecting an oil separator 2 and the second chamber 17*c* of the accumulator 17A, and numeral 11*c* is a sixth oil return device disposed at a pipe midpoint of the third oil return bypass 10*b*. Numeral 9*c* is an inflow pipe connected to the first chamber 17*b* of the accumulator 17A from the indoor heat exchanger 5. Numeral 17*d* is a large air hole disposed on the top of the partition plate 17*a*. Fluid can circulate only through the air hole 17*d* between the first and second chambers 17*b* and 17*c*. That is, although the total volume is the same, as compared with the system comprising the first and second accumulators 6 and 7, only one accumulator 17A is provided. Thus, the space is saved and the number of brazed points is reduced.

Flows of a refrigerant and oil will be discussed. The flow from the compressor 1 to indoor heat exchanger 5 is the same as that in the refrigerant circuit of the air conditioning systems according to embodiments 1 and 2 and therefore will not be discussed again. The refrigerant flowing out of the indoor heat exchanger 5 flows via the inflow pipe 9*c* into the first chamber 17*b* of the accumulator 17A and gas refrigerant flows through the air hole 17*d* into the second chamber 17*c* of the accumulator 17A and returns via the U-effluent pipe 18 and the connection pipe 9*b* to the compressor 1. That is, the refrigerant passes through only one accumulator 17A between the indoor heat exchanger 5 and the compressor 1, so that the pressure loss from the indoor heat exchanger 5 to the compressor 1 lessens. On the other hand, the oil separated by the oil separator 2 flows via the sixth oil return device 11*c* and the sixth oil return bypass 10*c* into the second chamber 17*c* of the accumulator 17A and returns through the oil return hole 19 via the U-effluent pipe 18 to the compressor 1. Since separation of the oil from the refrigerant at the oil separator 2 is not complete, oil together with the liquid refrigerant accumulates in the first chamber 17*b* of the accumulator 17A. The oil and liquid refrigerant flow via the seventh oil return device 13*c* and the seventh oil return bypass 12*c* into the connection pipe 9*b* and return to the compressor 1.

Generally, if an excess refrigerant is accumulated in the first chamber 17*b* of the accumulator 17A in large quantity, the oil separated by the oil separator 2 flows into the first chamber 17*b* of the accumulator 17A and is diluted with the liquid refrigerant in the first chamber 17*b* and the oil return from the first chamber 17*b* to the compressor 1 is delayed, causing oil exhaustion in the compressor 1. However, this does not occur even if an excess refrigerant is accumulated in the first chamber 17*b* of the accumulator 17A in large quantity, because the sixth oil return bypass 10*c* is connected to the second chamber 17*c* of the accumulator 17A. The oil separated by the oil separator 2 promptly returns via the second chamber 17*c* to the compressor 1, providing a sufficient amount of oil in the compressor 1.

When the system is started in the condition in which the compressor 1 stops for a long time and a liquid refrigerant is allowed to stand in the shell of the compressor 1, the liquid refrigerant and oil in the shell are discharged in large quantity. The oil separator 2 traps the liquid refrigerant and oil, inhibiting efflux of a large amount of oil to a heat source machine heat exchanger 3, etc. Since the sixth oil return bypass 10*c* is connected to the second chamber 17*c* of the accumulator 17A, a large amount of the liquid refrigerant trapped in the oil separator 2 once flows into the second chamber 17*c* without directly returning to the compressor 1 and returns through the oil return hole 19 to the compressor 1 little by little. Thus, damage to the compressor 1 caused by a rapid back flow of fluid can be inhibited. Generally, if an excess refrigerant is accumulated in the first chamber 17*b* in large quantity, the oil together with the liquid refrigerant trapped in the oil separator 2 flows into the first chamber 17*b* and is diluted with the liquid refrigerant in the first chamber 17*b* and the oil return from the first chamber 17*b* to the compressor 1 is delayed, causing oil exhaustion in the compressor 1. However, this can be suppressed even if an excess refrigerant is accumulated in the first chamber 17*b* in large quantity, because the sixth oil return bypass 10*c* is connected to the second chamber 17*c*.

Thus, there can be provided an air conditioning system exhibiting a sufficient refrigeration capability, wherein the space is saved, a small number of points are brazed, and the pressure loss from the indoor heat exchanger 5 to the compressor 1 is lessened while the original oil return function and fluid back flow inhibition function are provided.

Figure 4:
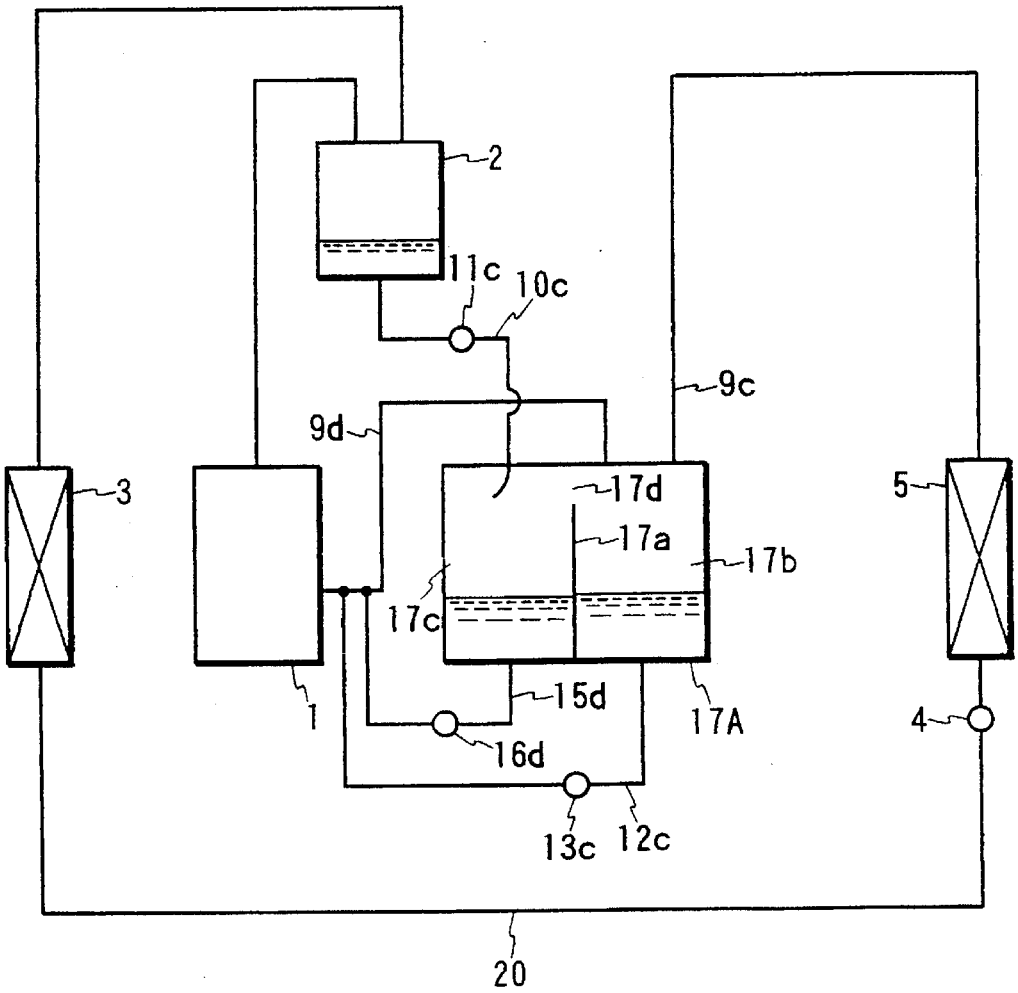
FIG. 4 is a refrigerant circuit diagram of an air conditioning system according to embodiment 4 of the invention.

Embodiment 4:

FIG. 4 is a refrigerant circuit diagram of an air conditioning system according to the fourth embodiment of the invention. In the figure, numerals 1 to 5, 9*c*, 10*c*, 11*c*, 12*c*, 13*c*, 17A, 17*a*, 17*b* , 17*c*, and 17*d* are identical with or similar to those of the refrigerant circuit of the air conditioning system according to the third embodiment described with reference to FIG. 3, and therefore will not be discussed again. Numeral 9*d* is a connection pipe for connecting a compressor 1 and a first chamber 17*b* of an accumulator 17A, numeral 15*d* is an eighth oil return bypass for connecting the bottom of a second chamber 17*c* of the accumulator 17A and a connection pipe 9*d*, and numeral 16*d* is an eighth oil return device disposed at a pipe midpoint of the eighth oil return bypass 15*d* and, for example, made of an orifice or capillary.

Also in the embodiment, although the total volume is the same, as compared with the system comprising the first and second accumulators 6 and 7, only one accumulator is provided. Thus, the space is saved and the number of brazed points is reduced.

Next, flows of a refrigerant and oil will be discussed. The flow from the compressor 1 to indoor heat exchanger 5 is the same as that in the refrigerant circuit of the air conditioning systems according to embodiments 1 to 3 and therefore will not be discussed again. The refrigerant flowing out of the indoor heat exchanger 5 flows via the inflow pipe 9*c* into the first chamber 17*b* of the accumulator 17A and gas refrigerant returns via the connection pipe 9*d* to the compressor 1 (not via the second chamber 17*c*). That is, the refrigerant passes through only one accumulator 17A between the indoor heat exchanger 5 and the compressor 1, so that the pressure loss from the indoor heat exchanger 5 to the compressor 1 lessens. On the other hand, the oil separated by an oil separator 2 flows via a sixth oil return device 11*c* and a sixth oil return bypass 10*c* into the second chamber 17*c* of the accumulator 17A and returns via the eighth oil return device 16*d* and the eighth oil return bypass 15*d* to the compressor 1. Since separation of the oil from the refrigerant at the oil separator 2 is not complete, oil together with the liquid refrigerant accumulates in the first chamber 17*b* of the accumulator 17A. The oil and liquid refrigerant flow via a seventh oil return device 13*c* and a seventh oil return bypass 12*c* into the connection pipe 9*d* and return to the compressor 1.

Generally, if an excess refrigerant is accumulated in the first chamber 17*b* of the accumulator 17A in large quantity, the oil separated by the oil separator 2 flows into the first chamber 17*b* of the accumulator 17A and is diluted with the liquid refrigerant in the first chamber 17*b* and the oil return from the first chamber 17*b* to the compressor 1 is delayed, causing oil exhaustion in the compressor 1. However, this does not occur even if an excess refrigerant is accumulated in the first chamber 17*b* of the accumulator 17A in large quantity, because the sixth oil return bypass 10*c* is connected to the second chamber 17*c* of the accumulator 17A. The oil separated by the oil separator 2 promptly returns via the second chamber 17*c* to the compressor 1, providing a sufficient amount of oil in the compressor 1.

When the system is started in the condition in which the compressor 1 stops for a long time and a liquid refrigerant is allowed to stand in the shell of the compressor 1, the liquid refrigerant and oil in the shell are discharged in large quantity. The oil separator 2 traps the liquid refrigerant and oil, inhibiting efflux of a large amount of oil to a heat source machine heat exchanger 3, etc. Since the sixth oil return bypass 10*c* is connected to the second chamber 17*c* of the accumulator 17A, a large amount of the liquid refrigerant trapped in the oil separator 2 once flows into the second chamber 17*c* without directly returning to the compressor 1 and returns through the eighth oil return device 16*d* comprising a constant flow path always provided by the orifice or capillary (one example of a third flow quantity controller), the eighth oil return bypass 15*d* to the compressor 1 little by little. Thus, damage to the compressor 1 caused by a rapid back flow of fluid can be inhibited. Generally, if an excess refrigerant is accumulated in the first chamber 17*b* in large quantity, the oil together with the liquid refrigerant trapped in the oil separator 2 flows into the first chamber 17*b* and is diluted with the liquid refrigerant in the first chamber 17*b* and the oil return from the first chamber 17*b* to the compressor 1 is delayed, causing oil exhaustion in the compressor 1. However, this can be suppressed even if an excess refrigerant is accumulated in the first chamber 17*b* in large quantity, because the sixth oil return bypass 10*c* is connected to the second chamber 17*c*.

Thus, there can be provided an air conditioning system exhibiting a sufficient refrigeration capability, wherein the space is saved, a small number of points are brazed, and the pressure loss from the indoor heat exchanger 5 to the compressor 1 is lessened while the original oil return function and fluid back flow inhibition function are provided. Moreover, unlike the third embodiment, gas refrigerant does not pass through the air hole 17*d*, so that the refrigerant circuit of the air conditioning system of the fourth embodiment has a smaller pressure loss than that of the third embodiment.

Figure 5:
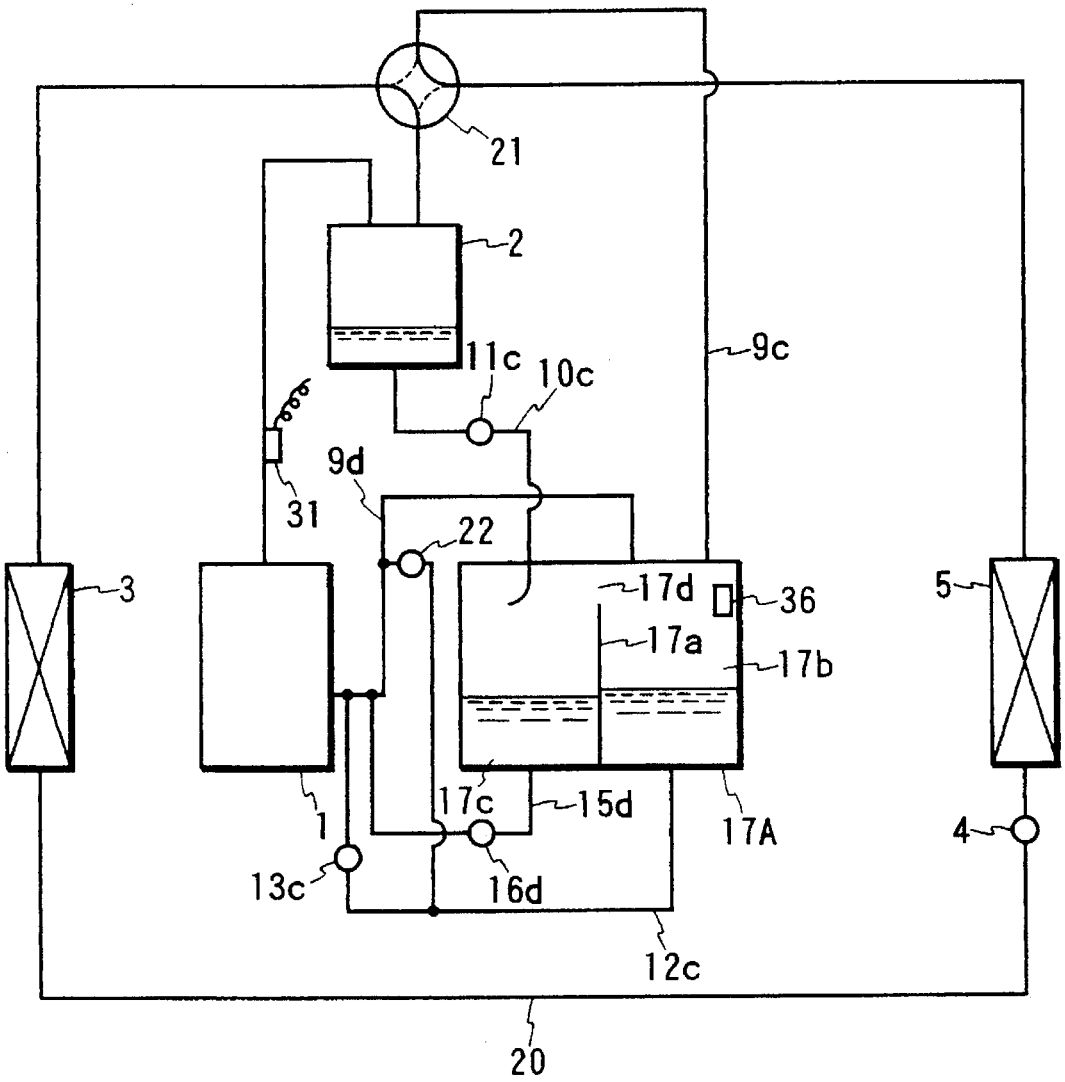
FIG. 5 is a refrigerant circuit diagram of an air conditioning system according to embodiment 5 of the invention.

Embodiment 5:

FIG. 5 is a refrigerant circuit diagram of an air conditioning system which enables switching between cooling and heating operation modes according to the fifth embodiment of the invention. In the figure, numerals 1 to 5, 9*c*, 9*d*, 10*c*, 11*c*, 12*c*, 13*c*, 15*d*, 16*d*, 17A, 17*a*, 17*b*, 17*c*, 17*d*, and 20 are identical with or similar to those of the refrigerant circuit of the air conditioning system according to the fourth embodiment described with reference to FIG. 4, and therefore will not be discussed again. Numeral 22 is a ninth oil return device (an example of a second flow quantity controller and an example of an inflow prevention mechanism) made of an orifice or capillary, disposed in parallel with a seventh oil return device 13*c* and on a seventh oil return bypass 12*c* positioned higher than the highest liquid level of an accumulator 17A, numeral 21 is a four-way switch valve for switching a refrigerant flow path when the operation is switched between the cooling and heating modes, numeral 31 is discharged gas temperature detection unit disposed on a discharge pipe of a compressor 1 for detecting a temperature of discharged gas refrigerant, and numeral 36 is liquid level detection unit disposed in a first chamber 17*b* of the accumulator 17A for detecting the liquid level in the first chamber 17*b*. The seventh oil return device 13*c* (one example of a first flow quantity controller) is made of an electric expansion valve whose opening is variable.

Also in the embodiment, although the total volume is the same, as compared with the system comprising the first and second accumulators 6 and 7, only one accumulator is provided. Thus, the space is saved and the number of brazed points is reduced.

Next, flows of a refrigerant and oil in the cooling mode operation will be discussed. The flow from the compressor 1 to indoor heat exchanger 5 is the same as that in the refrigerant circuit of the air conditioning system according to embodiment 4 and therefore will not be discussed again. The refrigerant flowing out of the four-way switch valve 21 flows via an inflow pipe 9*c* into the first chamber 17*b* of the accumulator 17A and gas refrigerant returns via a connection pipe 9*d* to the compressor 1 (not via a second chamber 17*c* of the accumulator 17A). That is, the refrigerant passes through only one accumulator 17A between the four-way switch valve 21 and the compressor 1, so that the pressure loss from the four-way switch valve to the compressor 1 lessens. On the other hand, the oil separated by an oil separator 2 flows via a sixth oil return device 11*c* and a sixth oil return bypass 10*c* into the second chamber 17*c* of the accumulator 17A and returns via the eighth oil return device 16*d* and the eighth oil return bypass 15*d* to the compressor 1.

Since separation of the oil from the refrigerant at the oil separator 2 is not complete, oil together with the liquid refrigerant accumulates in the first chamber 17*b* of the accumulator 17A. The oil and liquid refrigerant flow via the seventh oil return device 13*c* or the ninth oil return device 22 and the seventh oil return bypass 12*c* into the connection pipe 9*d* and return to the compressor 1. Generally, if an excess refrigerant is accumulated in the first chamber 17*b* of the accumulator 17A in large quantity, the oil separated by the oil separator 2 flows into the first chamber 17*b* of the accumulator 17A and is diluted with the liquid refrigerant in the first chamber 17*b* and the oil return from the first chamber 17*b* to the compressor 1 is delayed, causing oil exhaustion in the compressor 1. However, this does not occur even if an excess refrigerant is accumulated in the first chamber 17*b* of the accumulator 17A in large quantity, because the sixth oil return bypass 10*c* is connected to the second chamber 17*c* of the accumulator 17A. The oil separated by the oil separator 2 promptly returns via the second chamber 17*c* to the compressor 1, providing a sufficient amount of oil in the compressor 1.

When the system is started in the condition in which the compressor 1 stops for a long time and a liquid refrigerant is allowed to stand in the shell of the compressor 1, the liquid refrigerant and oil in the shell are discharged in large quantity. The oil separator 2 traps the liquid refrigerant and oil, inhibiting efflux of a large amount of oil to a heat exchanger, etc. Since the sixth oil return bypass 10*c* is connected to the second chamber 17*c* of the accumulator 17A, a large amount of the liquid refrigerant trapped in the oil separator 2 once flows into the second chamber 17*c* without directly returning to the compressor 1 and returns through the eighth oil return device 16*d* to the compressor 1 little by little. Thus, damage to the compressor 1 caused by a rapid back flow of fluid can be inhibited.

Likewise, generally, if an excess refrigerant is accumulated in the first chamber 17*b* in large quantity, the oil together with the liquid refrigerant trapped in the oil separator 2 flows into the first chamber 17*b* and is diluted with the liquid refrigerant in the first chamber 17*b* and the oil return from the first chamber 17*b* to the compressor 1 is delayed, causing oil exhaustion in the compressor 1. However, this can be suppressed even if an excess refrigerant is accumulated in the first chamber 17*b* in large quantity, because the sixth oil return bypass 10*c* is connected to the second chamber 17*c*.

For reference, flows of a refrigerant and oil in the heating mode operation will be discussed. The high-temperature and high-pressure gas refrigerant discharged from the compressor 1 flows into the oil separator 2, which then separates the gas refrigerant and oil. The gas refrigerant flows via the four-way switch valve 21 into an indoor heat exchanger 5 (in this case, a condenser), which exchanges heat between the gas refrigerant and air, water, etc., and condenses and liquefies the gas refrigerant. The liquid refrigerant flows into a expansion device 4, through which the refrigerant becomes a low-pressure vapor-liquid two-phase condition. The refrigerant in the low-pressure vapor-liquid two-phase condition flows through a liquid pipe 20 into a heat source machine heat exchanger 3 (in this case, an evaporator), which then exchanges heat between the refrigerant and air, water, etc. As a result, the refrigerant becomes gas or a vapor-liquid two-phase condition at large dryness and returns via the four-way switch valve 21, the inflow pipe 9*c*, the accumulator 17A, and a connection pipe 9*b* to the compressor 1. Since the refrigerant density in the liquid pipe 20 is smaller than that in the cooling mode operation, the amount of the refrigerant corresponding to the density difference remains in the first chamber 17*b* of the accumulator 17A as an excess refrigerant larger than that in the cooling operation. The oil flow is the same as that in the cooling operation and will not be discussed.

Redundance of the seventh oil return bypass 12*c* will be discussed. Even if the seventh oil return device 13*c* fails in a mode in which it is locked at fully closed opening, oil can be returned from the ninth oil return device 22 and oil exhaustion in the compressor 1 does not occur if the operation range is reasonable.

Fluid flow prevention into the second chamber 17*c* of the accumulator 17A from the first chamber 17*b* when the compressor 1 stops will be discussed. Normally, an excess refrigerant accumulates in the first chamber 17*b* of the accumulator 17A, thus the first chamber 17*b* has a higher liquid level than the second chamber 17*c* of the accumulator 17A. Therefore, assuming that the position at which the ninth oil return device 22 is disposed is low, when the compressor 1 stops, the liquid refrigerant in the first chamber 17*b* of the accumulator 17A passes through the ninth oil return device 22 and flows back via the connection pipe 9*d* and the eighth oil return device 16*d* into the second chamber 17*c* of the accumulator 17A. If the compressor 1 is started in this condition, each time it is started, the liquid refrigerant accumulated in the second chamber 17*c* of the accumulator 17A when the compressor 1 stops flows back into the compressor 1 and oil in the compressor 1 is diluted, lowering reliability of the compressor 1.

However, since the position at which the ninth oil return device 22 is disposed is higher than the highest liquid level in the accumulator 17A, when the compressor 1 stops, the liquid refrigerant in the first chamber 17*b* of the accumulator 17A does not flow into the connection pipe 9*d* from the ninth oil return device 22. Therefore, each time the compressor 1 is started, back flow of fluid into the compressor 1 does not occur and reliability of the compressor 1 does not lower.

Figure 6:
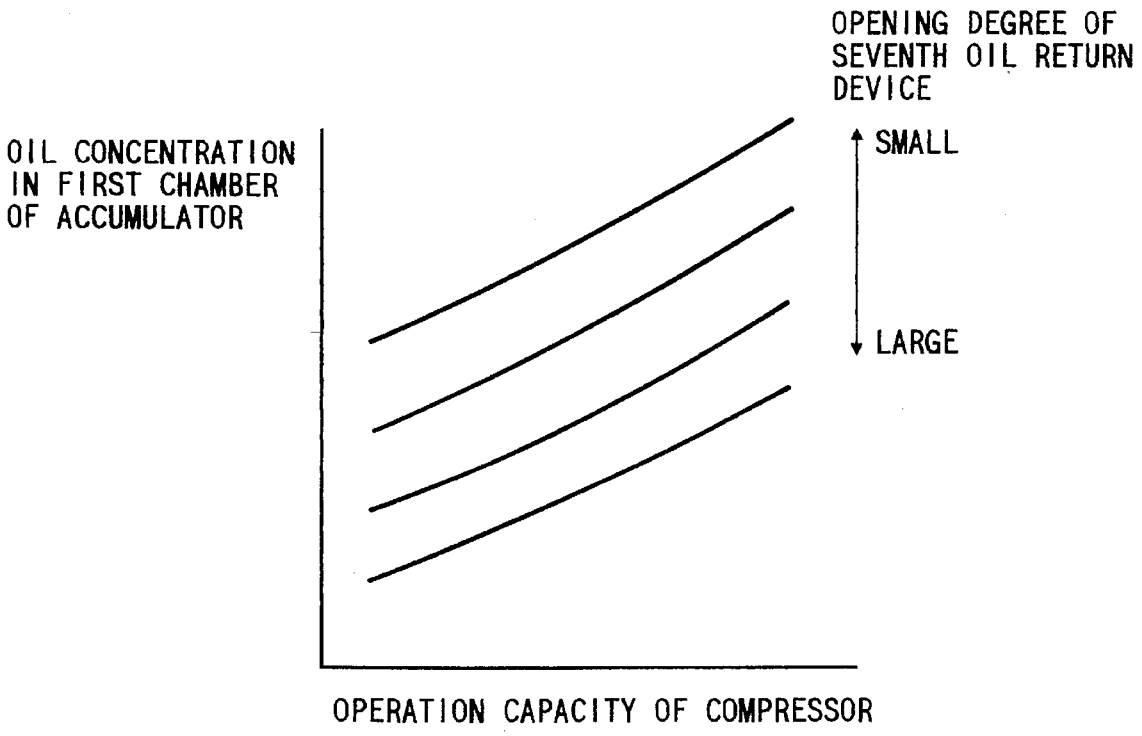
FIG. 6 is a correlation diagram showing the relationship between the oil concentration in a first chamber of an accumulator and the compressor capacity in the air conditioning system according to embodiment 5 of the invention.

Next, the operation of the seventh oil return device 13*c* will be discussed. FIG. 6 is a correlation diagram showing the relationship between the operation capacity of the compressor 1 and the oil concentration in the first chamber 17*b* of the accumulator 17A.

The larger the operation capacity of the compressor 1, the larger the amount of oil discharged from the compressor 1. The larger the operation capacity of the compressor 1, the lower the oil separation efficiency of the oil separator 2 (=oil flow quantity through sixth oil return bypass 10*c*/oil flow quantity into oil separator 2). Therefore, as shown in FIG. 6, if the opening degree of the seventh oil return device 13*c* is constant, the oil concentration in the first chamber 17*b* of the accumulator 17A has a simple increase relationship with the operation capacity of the compressor 1. When the opening degree of the seventh oil return device 13*c* increases, the oil in the first chamber 17*b* of the accumulator 17A decreases, thus the oil concentration lowers as shown in FIG. 6.

Then, the seventh oil return device 13*c* is controlled in response to the operation capacity of the compressor 1 in such a manner that when the operation capacity of the compressor 1 is small, the opening degree of the seventh oil return device 13*c* is made small and that when the operation capacity of the compressor 1 is large, the opening degree of the seventh oil return device 13*c* is made large, whereby the oil concentration in the first chamber 17*b* of the accumulator 17A can be set to a given value or less and oil exhaustion in the compressor 1 does not occur.

The higher the liquid level in the first chamber 17*b* of the accumulator 17A, the larger the pressure difference occurring across the seventh oil return device 13*c* and the larger the flow quantity through the seven oil return device 13*c*. Therefore, to hold the oil concentration in the first chamber 17*b* of the accumulator 17A a given value or less, the opening degree of the seventh oil return device 13*c* need not be made large; if the opening degree of the seventh oil return device 13*c* is made large, back flow of fluid into the compressor 1 increases. Therefore, to inhibit back flow of fluid into the compressor 1, the opening degree of the seventh oil return device 13*c* needs to be made smaller than that when the liquid level is low. That is, the opening degree of the seventh oil return device 13*c* is controlled in response to the liquid level in the first chamber 17*b* of the accumulator 17A, whereby the oil concentration in the first chamber 17*b* of the accumulator 17A can be set to a given value or less and oil exhaustion in the compressor 1 is not caused. Back flow of fluid into compressor 1 can also be inhibited. Since the liquid level in the first chamber 17*b* of the accumulator 17A is low in the cooling operation and is high in the heating operation, the seventh oil return device 13*c* is controlled in response to the operation mode in such a manner that the opening degree of the seventh oil return device 13*c* is made small in the cooling operation and that it is made large in the heating operation, whereby the same effect as described above can be produced.

When the opening degree of the seventh oil return device 13*c* is made large, back flow of fluid into the compressor 1 increases. Thus, when the discharged gas temperature becomes too high, if the opening degree of the seventh oil return device 13*c* is made large, the discharged gas temperature from the compressor 1 can be lowered. In contrast, when the back flow of fluid into the compressor 1 is large and the discharged gas temperature becomes too low, the back flow of fluid can be inhibited by making the opening degree of the seventh oil return device 13*c* small.

When the compressor 1 is started, the liquid refrigerant returns to the accumulator 17A and the liquid level in the first chamber 17*b* of the accumulator 17A becomes higher than the normal level, increasing the back flow of fluid into the compressor 1. When the compressor 1 is started, particularly when it is started in the condition in which the compressor 1 stops for a long time and a liquid refrigerant is allowed to stand in the shell of the compressor 1, the liquid refrigerant and oil in the shell are discharged in large quantity. The liquid refrigerant and oil are trapped in the oil separator 2, flows via the sixth oil return bypass 10*c* into the second chamber 17*c*, and returns through the eighth oil return device 16*d* to the compressor 1. Thus, the back flow of fluid into the compressor 1 increases as compared with the normal time. Then, the opening degree of the seventh oil return device 13*c* is made smaller than the normal opening until a lapse of a given time after the compressor 1 starts, whereby the back flow of fluid into the compressor 1 at the starting can be decreased.

Next, specific control operation of the seventh oil return device 13*c* will be discussed in conjunction with a control block diagram shown in FIG. 7 and a flowchart shown in FIG. 8.

Figure 7:
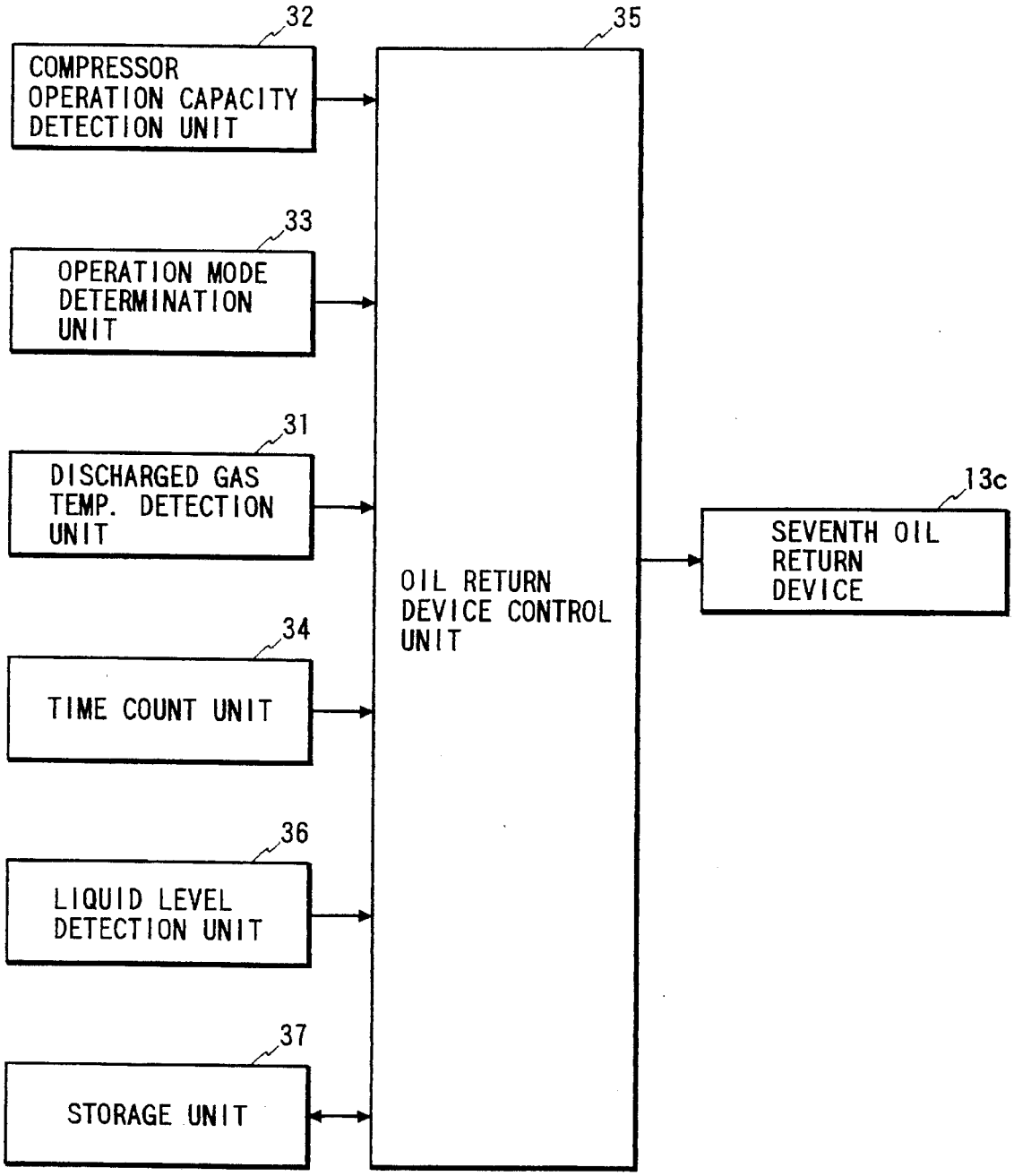
FIG. 7 is a control block diagram of the air conditioning system according to embodiment 5 of the invention.
Figure 8:
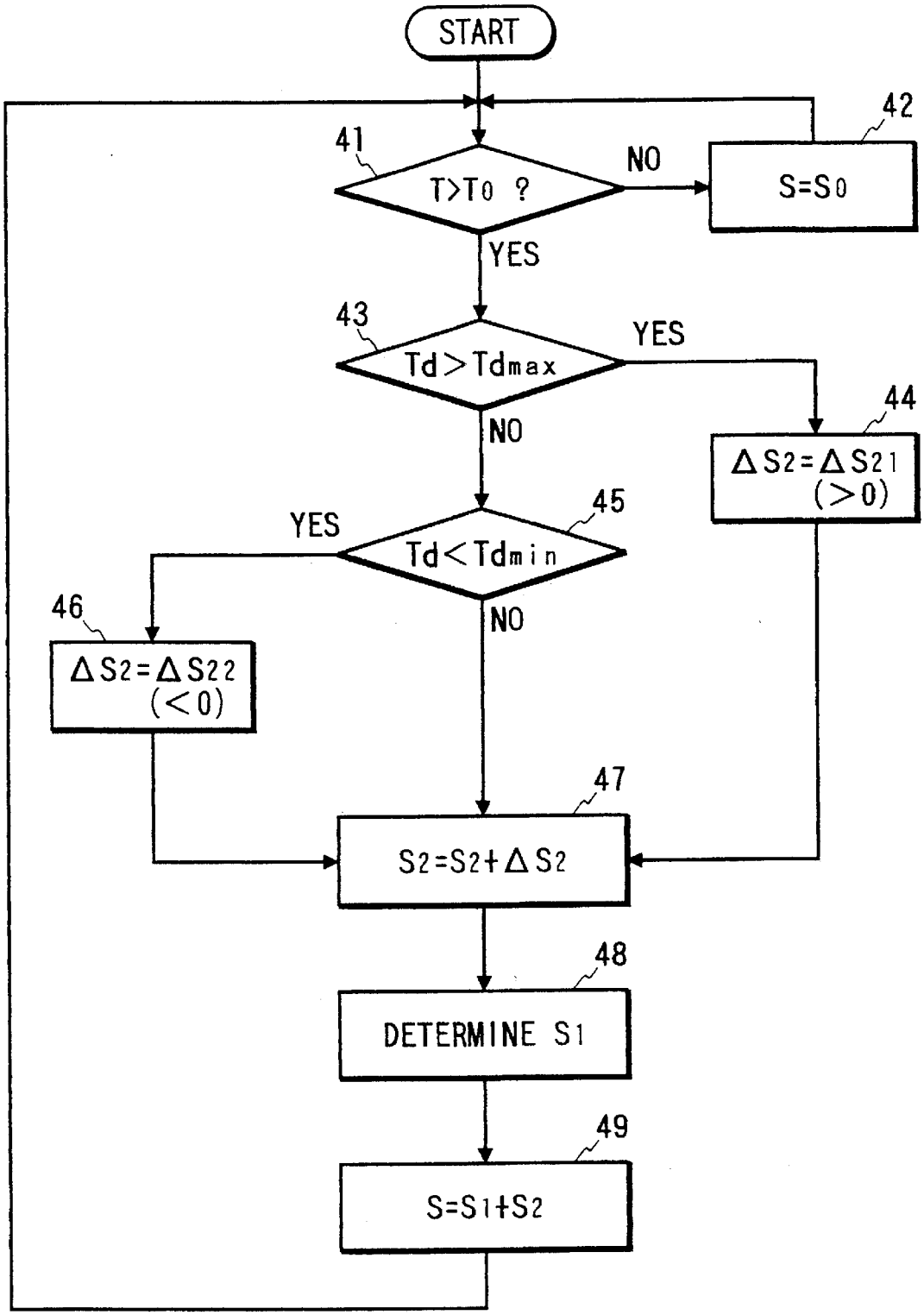
FIG. 8 is a control flowchart of oil return device control means of the air conditioning system according to embodiment 5 of the invention.

In FIG. 7, numeral 32 is compressor operation capacity detection unit for detecting the operation capacity of the compressor 1, numeral 33 is operation mode determination unit for determining whether the current operation mode is cooling or heating, numeral 34 is time count unit for counting the operation time from the starting of the compressor 1, numeral 36 is the above-mentioned liquid level detection unit, numeral 37 is storage unit for storing relationship data between the predetermined operation capacity of the compressor 1 and the oil concentration in the first chamber 17*b* (see FIG. 6) or the opening degree of the seventh oil return device 13*c* (see FIG. 9), and numeral 35 is oil return device control unit (an example of each of first to fifth opening controllers) for determining the opening degree of the seventh oil return device 13*c* based on outputs from the discharged gas temperature detection unit 31, compressor operation capacity detection unit 32, operation mode determination unit 33, time count unit 34, liquid level detection unit 36, and storage unit 37 and outputting a control command to the seventh oil return device 13*c*.

The control operation of the oil return device control unit 35 will be described with reference to the flowchart in FIG. 8. Whether or not count time T of the time count unit 34 reaches preset time $T_0$ is determined at step 41. If T does not reach $T_0$, control goes to step 42 for decreasing the back flow of fluid into the compressor 1. The opening S of the seventh oil return device 13*c* is set to fully closed opening $S_0$ and control returns to step 41. If the count time T of the time count unit 34 reaches the preset time $T_0$, control goes to step 43 and whether or not detection temperature Td of the discharged gas temperature detection unit 31 is higher than preset allowable upper limit of discharged gas temperature, Tdmax, is determined. If Td is higher than Tdmax, control goes to step 44; otherwise, control goes to step 45. Whether or not the detection temperature Td of the discharged gas temperature detection unit 31 is lower than preset allowable lower limit of discharged gas temperature, Tdmin (predetermined temperature), is determined at step 45. If Td is lower than Tdmin, control goes to step 46; otherwise, control goes to step 47.

The opening S of the seventh oil return device 13*c* is calculated at step 49 described below as the sum of the opening $S_1$ determined based on the operation capacity of the compressor 1 determined by the compressor operation capacity determination unit 32 and the operation mode determined by the operation mode determination unit 33 and the opening $S_2$ determined based on the detection temperature of the discharged gas temperature detection unit 31 ($S=S_1+S_2$).

On the other hand, change amount of the opening $S_2$, $S_2$, is determined to be $S_2=S_{21}$ (>0) at step 44, and control goes to step 47. Change amount of the opening $S_1$, $S_2$, is determined to be $S_2=S_{22}$ (<0) at step 46, and control goes to step 47. The change amount $S_2$ is added to the preceding opening $S_2$ to find a new opening $S_2$ at step 47, and control goes to step 48.

Figure 9:
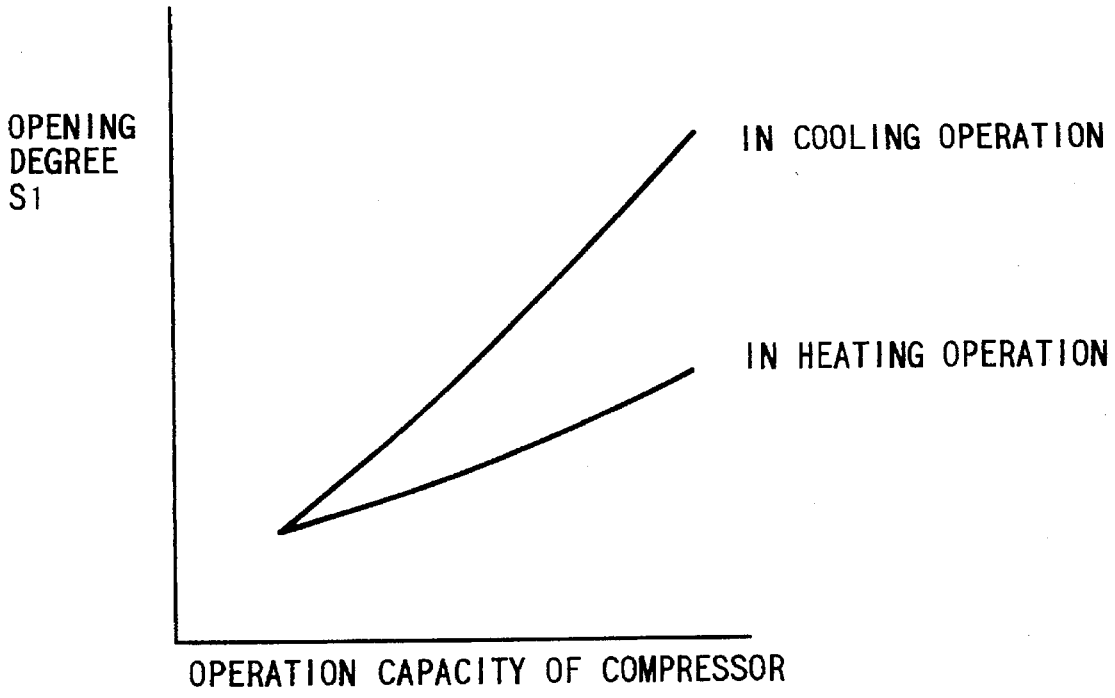
FIG. 9 is a correlation diagram showing the relationship between the oil return device opening and the compressor capacity in the air conditioning system according to embodiment 5 of the invention.

As shown in FIG. 9, the opening $S_1$ is determined from the relationship data between the operation capacity of the compressor 1 and the current operation mode at step 48, and control goes to step 49. The opening $S_1$ determined based on the operation capacity of the compressor 1 determined by the compressor operation capacity determination unit 32 and the operation mode determined by the operation mode determination unit 33 and the opening $S_2$ determined based on the detection temperature of the discharged gas temperature detection unit 31 are added to find the sum S at step 49, and control returns to step 41.

Thus, there can be provided an air conditioning system exhibiting a sufficient refrigeration capability, wherein the space is saved, a small number of points are brazed, and the pressure loss from the four-way switch valve 21 to the compressor 1 is lessened while the original oil return function and fluid back flow inhibition function are provided.

Figure 10:
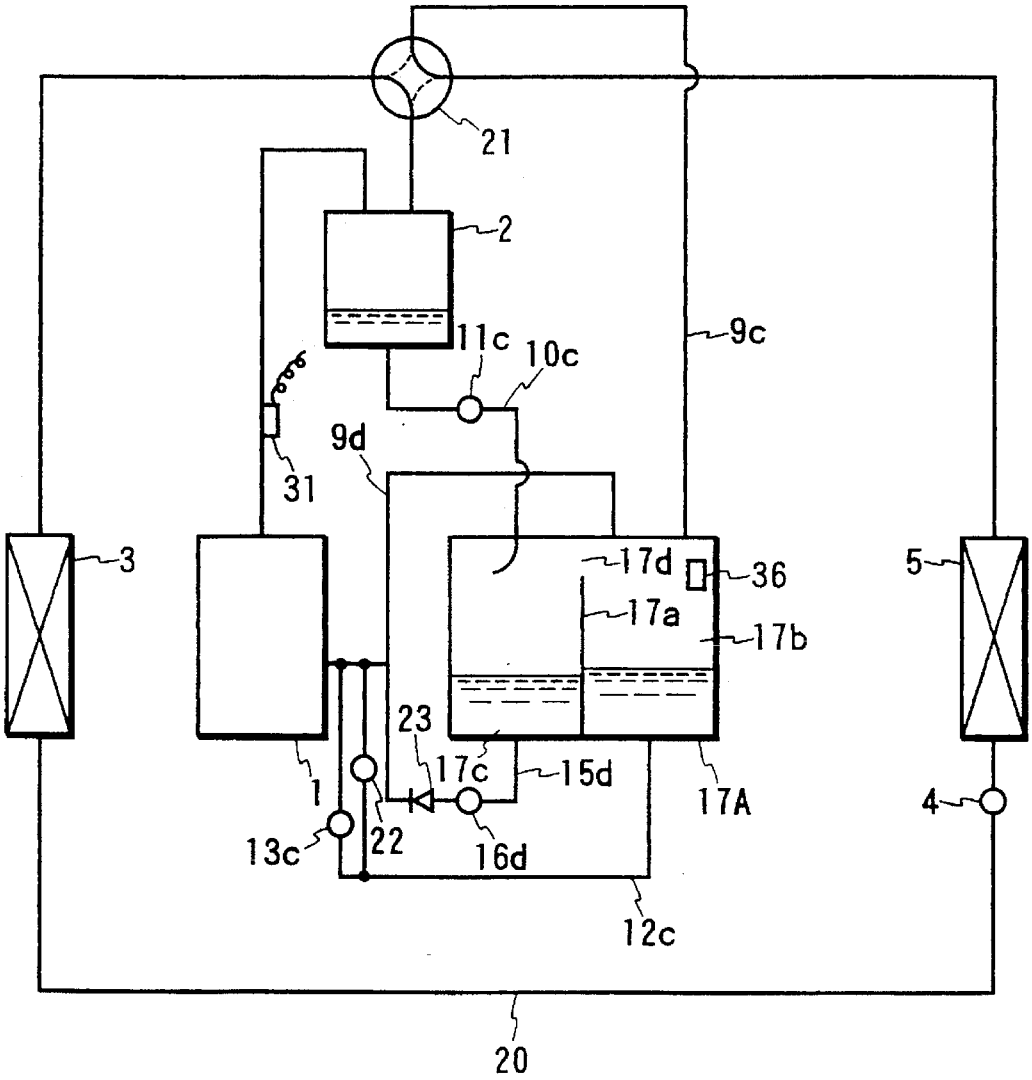
FIG. 10 is a refrigerant circuit diagram of an air conditioning system according to embodiment 6 of the invention.

Embodiment 6:

FIG. 10 is a refrigerant circuit diagram of an air conditioning system according to the sixth embodiment of the invention. In the figure, numerals 1 to 5, 9*c*, 9*d*, 10*c*, 11*c*, 12*c*, 13*c*, 15*d*, 16*d*, 17A, 17*a*, 17*b*, 17*c*, 17*d*, 20 to 22, 31, and 36 are identical with or similar to those of the refrigerant circuit of the air conditioning system according to the fifth embodiment described with reference to FIG. 5, and therefore will not be discussed again. Numeral 23 is a check valve (another example of inflow prevention mechanism) disposed in series with an eighth oil return device 16*d* at a pipe midpoint of an eighth oil return bypass 15*d* in such a direction as to allow only fluid flow heading toward the compressor 1.

The sixth embodiment is the same as the first embodiment except for the fluid flow prevention function into a second chamber 17*c* of an accumulator 17A from a first chamber 17*b* when the compressor 1 stops. Therefore, only the fluid flow prevention function into the second chamber 17*c* of the accumulator 17A from the first chamber 17*b* when the compressor 1 stops will be discussed here. In FIG. 10, normally an excess refrigerant accumulates in the first chamber 17*b* of the accumulator 17A, thus the first chamber 17*b* has a higher liquid level than the second chamber 17*c* of the accumulator 17A.

Therefore, assuming that the check valve 23 is not provided and that the position at which a ninth oil return device 22 is disposed is low, when the compressor 1 stops, the liquid refrigerant in the first chamber 17*b* of the accumulator 17A passes through the ninth oil return device 22 and flows back via a connection pipe 9*d* and the eighth oil return device 16*d* into the second chamber 17*c* of the accumulator 17A. If the compressor 1 is started in this condition, each time it is started, the liquid refrigerant accumulated in the second chamber 17*c* of the accumulator 17A when the compressor 1 stops flows back into the compressor 1 and oil in the compressor 1 is diluted, lowering reliability of the compressor 1.

However, since the eighth oil return bypass 15*d* is provided with the check valve 23, when the compressor 1 stops, the liquid refrigerant in the first chamber 17*b* of the accumulator 17A flows into the connection pipe 9*d* from the ninth oil return device 22, but not into the second chamber 17*c* of the accumulator 17A. Therefore, each time the compressor 1 is started, back flow of fluid into the compressor 1 does not occur and reliability of the compressor 1 does not lower. The position at which the ninth oil return device is disposed need not be restricted.

Thus, there can be provided an air conditioning system exhibiting a sufficient refrigeration capability, wherein the space is saved, a small number of points are brazed, and the pressure loss from a four-way switch valve 21 to the compressor 1 is lessened while the original oil return function and fluid back flow inhibition function are provided.

Figure 11:
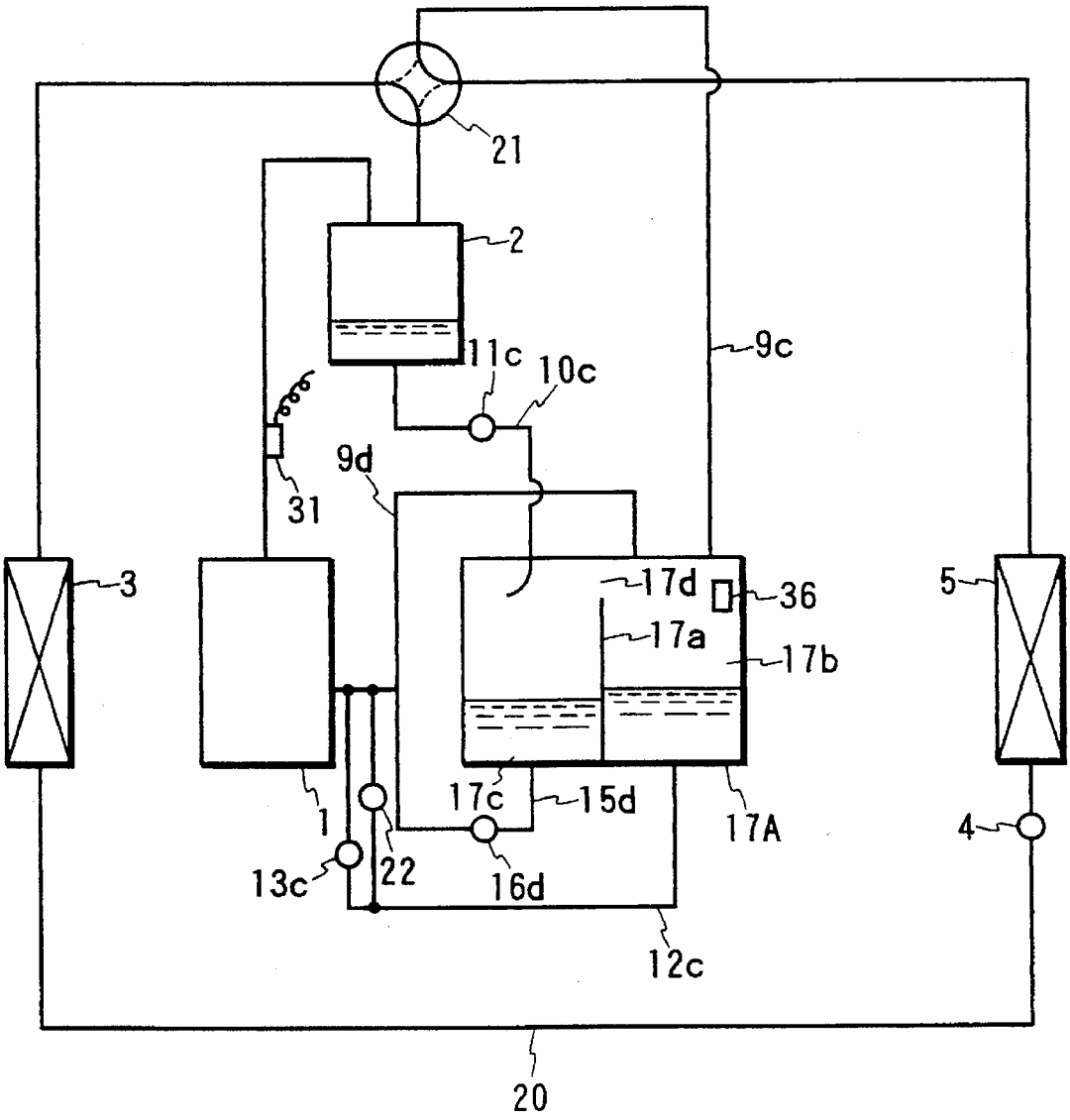
FIG. 11 is a refrigerant circuit diagram of an air conditioning system according to embodiment 7 of the invention.

Embodiment 7:

FIG. 11 is a refrigerant circuit diagram of an air conditioning system according to the seventh embodiment of the invention. In the figure, numerals 1 to 5, 9*c*, 9*d*, 10*c*, 11*c*, 12*c*, 13*c*, 15*d*, 16*d*, 17A, 17*a*, 17*b* , 17*c*, 17*d*, 20 to 22, 31, and 36 are identical with or similar to those of the refrigerant circuit of the air conditioning systems according to the fifth and sixth embodiments described with reference to FIGS. 5 and 10, and therefore will not be discussed again. A ninth oil return device 22 (another example of inflow prevention mechanism) is made of a solenoid valve that can be fully closed, and the position at which it is disposed is not restricted.

The seventh embodiment is the same as the first embodiment except for the operation of the solenoid valve of the ninth oil return device 22 and except for the fluid flow prevention function into a second chamber 17*c* of an accumulator 17A from a first chamber 17*b* when the compressor 1 stops. First, the operation of the solenoid valve of the ninth oil return device 22 will be discussed. When the compressor 1 is in operation, the solenoid valve of the ninth oil return device 22 is opened. When the compressor 1 stops, the solenoid valve of the ninth oil return device 22 is closed. Thus, the function of the compressor 1 during operation becomes similar to that in the fifth and sixth embodiments.

Next, the fluid flow prevention function into the second chamber 17*c* of the accumulator 17A from the first chamber 17*b* when the compressor 1 stops will be discussed here.

In FIG. 11, normally an excess refrigerant accumulates in the first chamber 17*b* of the accumulator 17A, thus the first chamber 17*b* has a higher liquid level than the second chamber 17*c* of the accumulator 17A. Therefore, assuming that the position at which the ninth oil return device 22 is disposed is low and that the solenoid valve of the ninth oil return device 22 is open, when the compressor 1 stops, the liquid refrigerant in the first chamber 17*b* of the accumulator 17A passes through the ninth oil return device 22 and flows back via a connection pipe 9*d* and an eighth oil return device 16*d* into the second chamber 17*c* of the accumulator 17A. If the compressor 1 is started in this condition, each time it is started, the liquid refrigerant accumulated in the second chamber 17*c* of the accumulator 17A when the compressor 1 stops flows back into the compressor 1 and oil in the compressor 1 is diluted, lowering reliability of the compressor 1.

However, since the solenoid valve of the ninth oil return device 22 is fully closed, when the compressor 1 stops, the liquid refrigerant in the first chamber 17*b* of the accumulator 17A does not flow into the connection pipe 9*d* from the ninth oil return device 22 and not into the second chamber 17*c* of the accumulator 17A either. Therefore, each time the compressor 1 is stated, back flow of fluid into the compressor 1 does not occur and reliability of the compressor 1 does not lower. The position at which the ninth oil return device is disposed need not be restricted.

Thus, there can be provided an air conditioning system exhibiting a sufficient refrigeration capability, wherein the space is saved, a small number of points are brazed, and the pressure loss from a four-way switch valve 21 to the compressor 1 is lessened while the original oil return function and fluid back flow inhibition function are provided.

Further, descriptions with respect to the accumulator used in the refrigerant circuit of the present invention will be given as follows.

Figure 12A:
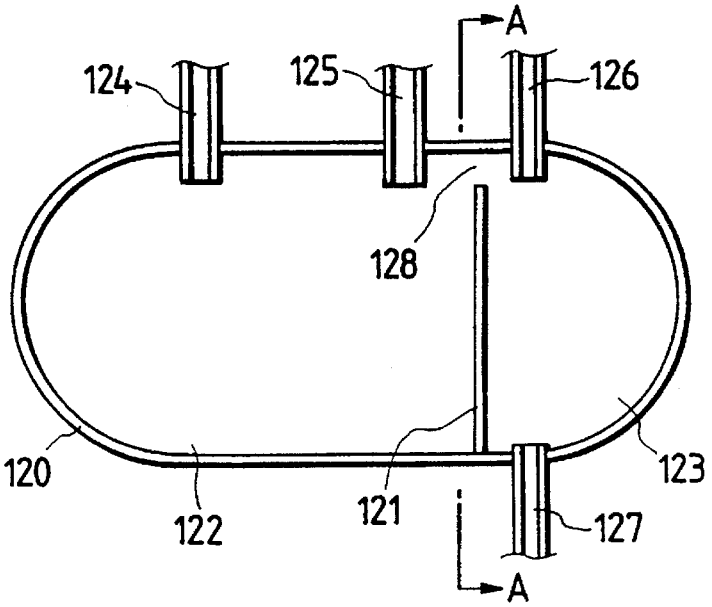
FIG. 12A is a sectional side view of an accumulator of a refrigerant circuit outdoor machine according to embodiment 8 of the invention.
Figure 12B:
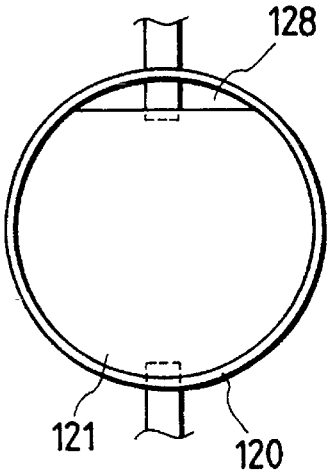
FIG. 12B is a cross sectional view at A—A line of FIG. 12A.

Embodiment 8:

FIG. 12A is a sectional side view of an accumulator of a refrigerant circuit outdoor machine according to a eighth embodiment of the invention and FIG. 12B is a cross sectional view at A—A line of FIG. 12A, wherein numeral 120 is an accumulator vessel, numeral 121 is a partition plate for partitioning off the accumulator vessel into two chambers, numeral 122 is a first chamber corresponding to the conventional first accumulator, numeral 123 is a second chamber corresponding to the conventional second accumulator, numeral 124 is a refrigerant inflow pipe disposed in the first chamber 122, numeral 125 is a refrigerant effluent pipe disposed in the first chamber 122, numeral 126 is an oil inflow pipe disposed in the second chamber 123, numeral 127 is an oil effluent pipe disposed at the bottom of the second chamber 123, and numeral 128 is a communication hole made in the partition plate 121 for allowing the first and second chambers 122 and 123 to communicate with each other.

Figure 13:
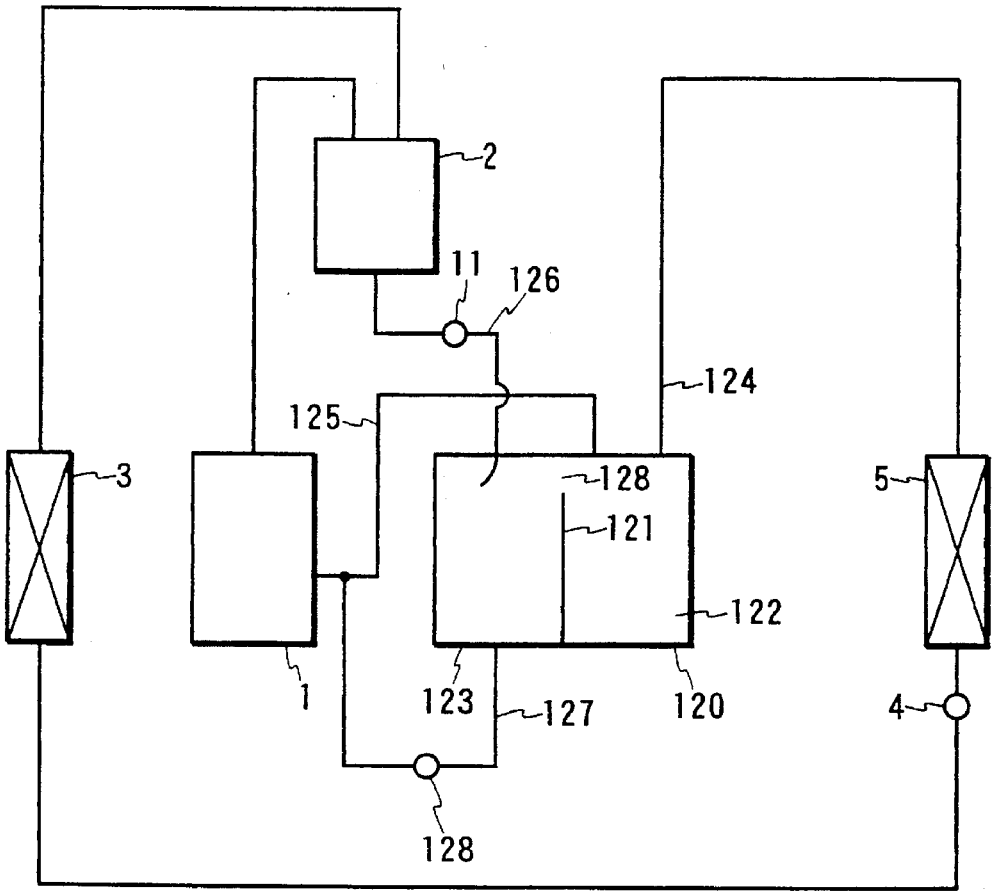
FIG. 13 is a block diagram showing the refrigerant circuit configuration of refrigerant circuit outdoor machine according to embodiment 8 of the invention.
Figure 41:
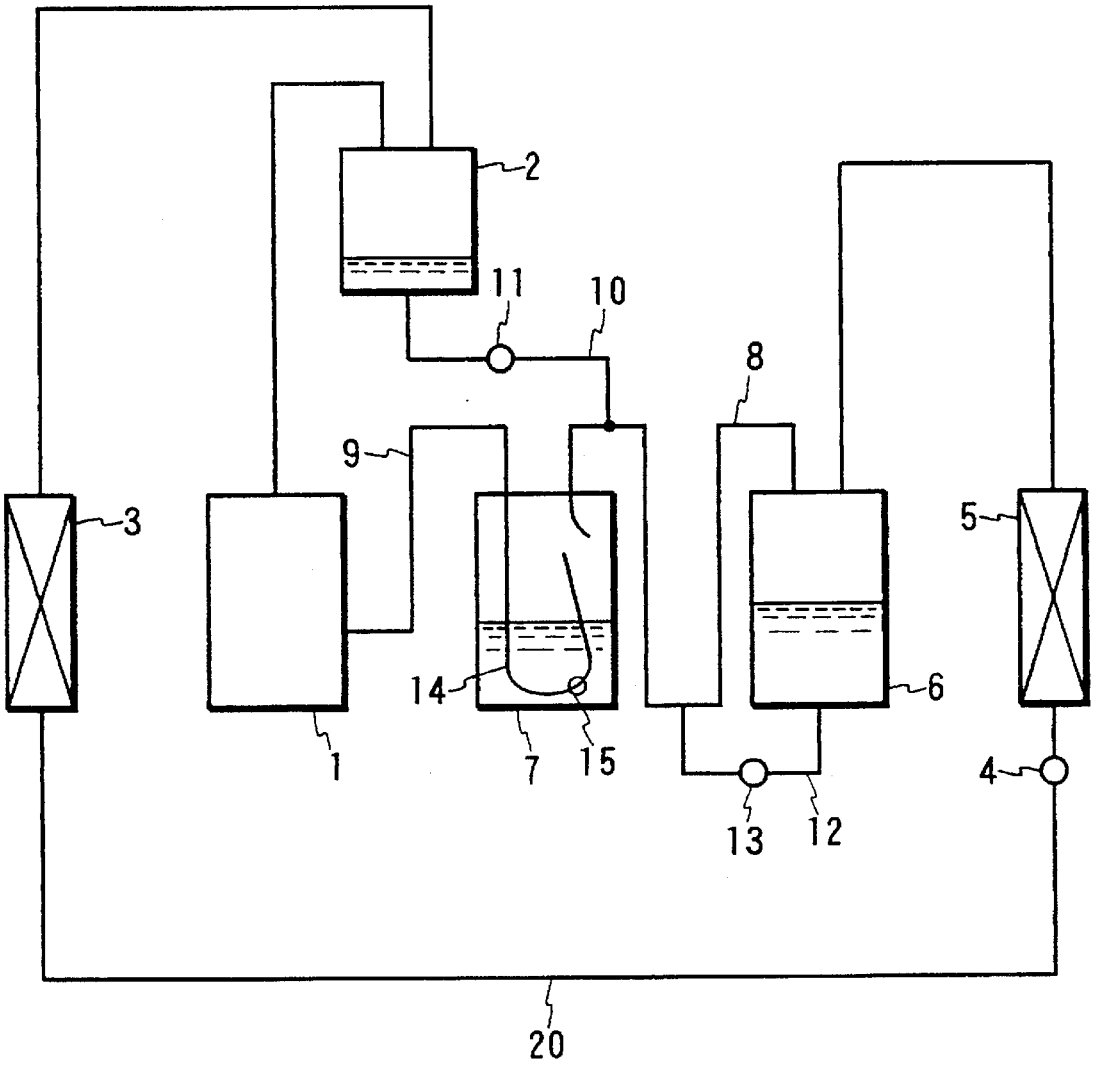
FIG. 41 is a refrigerant circuit diagram of a conventional air conditioning system.

FIG. 13 is a block diagram showing a refrigerant circuit of a building package air conditioner (PAC) outdoor machine according to the eighth embodiment of the invention, wherein numerals 1 to 5 and 11 are similar to or identical with those of the conventional refrigerant circuit shown in FIG. 41 and therefore will not be discussed again. Numeral 120 is an integral accumulator, numeral 121 is a partition plate for partitioning off the accumulator 120 into two parts, numeral 122 is a first chamber of the accumulator 120 partitioned with the partition plate 121, numeral 123 is a second chamber of the accumulator 120 partitioned with the partition plate 121, numeral 124 is a refrigerant inflow pipe flowing into the first chamber 122 of the accumulator 120 from an evaporator 5, numeral 125 is a refrigerant effluent pipe for connecting a compressor 1 and the first chamber 122 of the accumulator 120, numeral 126 is an oil inflow pipe for connecting an oil separator 2 and the second chamber 123 of the accumulator 120, numeral 127 is an oil effluent pipe disposed at the bottom of the second chamber 123 and connected to a midpoint of the refrigerant effluent pipe 125 via an oil return device 128, and numeral 128 is a communication hole made in the top of the partition plate 121 for allowing the first and second chambers 122 and 123 to communicate with each other.

Figure 42A:
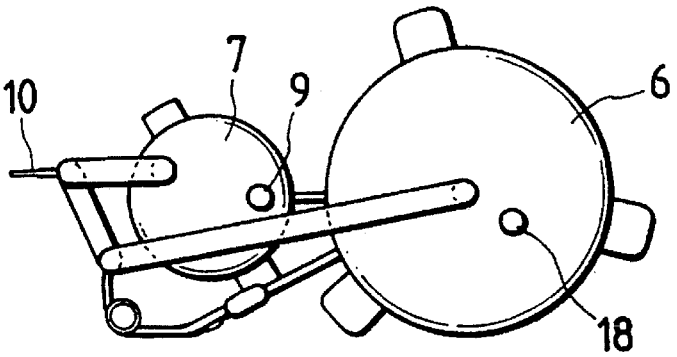
FIGS. 42A and 42B are a top view and a sectional side view of conventional accumulators of a refrigerant circuit outdoor machine.
Figure 42B:
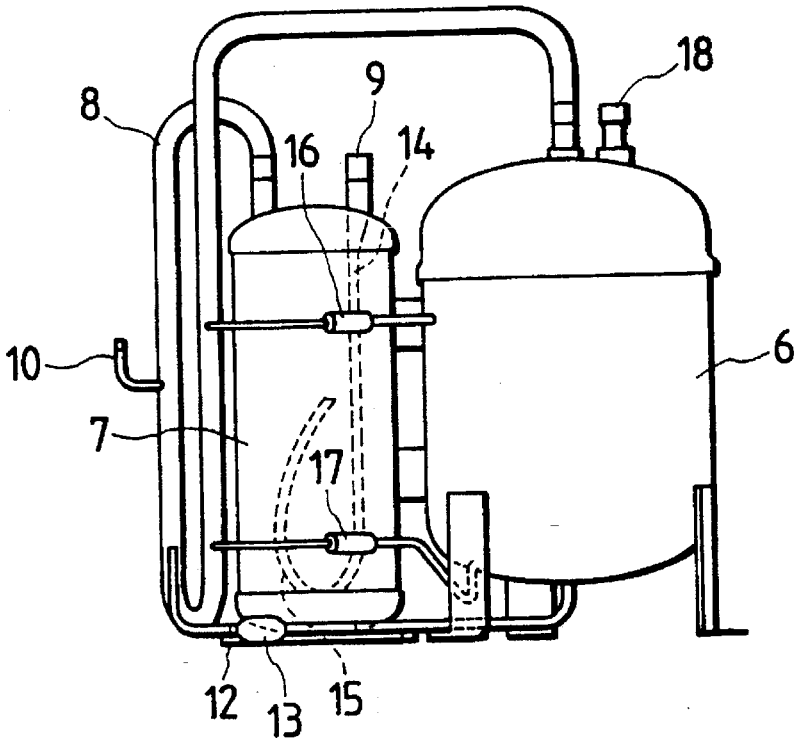

Next, flows of a refrigerant and oil when the accumulator of the invention is used will be discussed. Circuit parts identical with or similar to those described with reference to FIG. 42 are denoted by the same reference numerals in FIG. 13 and will not be discussed again. In FIG. 13, the refrigerant flowing out of the evaporator 5 flows into the first chamber 122 of the accumulator 120 via the refrigerant inflow pipe 124 and most of gas refrigerant. returns to the compressor 1 via the refrigerant effluent pipe 125 disposed in the first chamber 122. The liquid refrigerant is separated and accumulates in the first chamber 122. A small amount of the remainder flows into the second chamber 123 of the accumulator 120 through the communication hole 128 made in the partition plate 121 and returns via the oil effluent pipe 127 to the compressor 1. That is, the refrigerant passes through only one accumulator 120 between the evaporator 5 and the compressor 1, so that the pressure loss from the indoor heat exchanger 5 to the compressor 1 lessens. Moreover, since it passes through only one chamber 122, the pressure loss furthermore lessens. On the other hand, the oil separated by the oil separator 2 flows via an oil return device 11 and the oil inflow pipe 126 into the second chamber 123 of the accumulator 120 and returns via the oil effluent pipe 127 to the compressor 1. Thus, even if an excess liquid refrigerant is accumulated in the first chamber 122 of the accumulator 120 in large quantity, there are no worries that the oil separated by the oil separator 2 will flow into the first chamber 122 of the accumulator 120, thinning the oil concentration, because the oil inflow pipe 126 is connected to the second chamber 123. The oil separated by the oil separator 2 promptly returns via the second chamber 123 to the compressor 1, providing a sufficient amount of oil in the compressor 1. When the system is started in the condition in which the compressor 1 stops for a long time and a liquid refrigerant is allowed to stand in the shell of the compressor 1, the liquid refrigerant and oil in the shell are discharged in large quantity. The oil separator 2 traps the liquid refrigerant and oil, inhibiting efflux of a large amount of oil to a condenser, etc. Further, since the oil inflow pipe 126 is connected to the second chamber 123 of the accumulator 120, a large amount of the liquid refrigerant trapped in the oil separator 2 once flows into the second chamber 123 without directly returning to the compressor 1 and returns through the oil effluent pipe 127 to the compressor 1 little by little. Thus, high-pressure liquid compression caused by a rapid back flow of fluid does not occur and damage to the compressor 1 can be inhibited.

Thus, while the vapor and liquid separation function, oil return function, and fluid back flow inhibition function are provided, there can be provided an accumulator of a refrigerant circuit outdoor machine exhibiting a sufficient refrigeration capability, wherein the space is saved, a small number of points are brazed, and the pressure loss from the evaporator 5 to the compressor 1 can be lessened.

Figure 14:
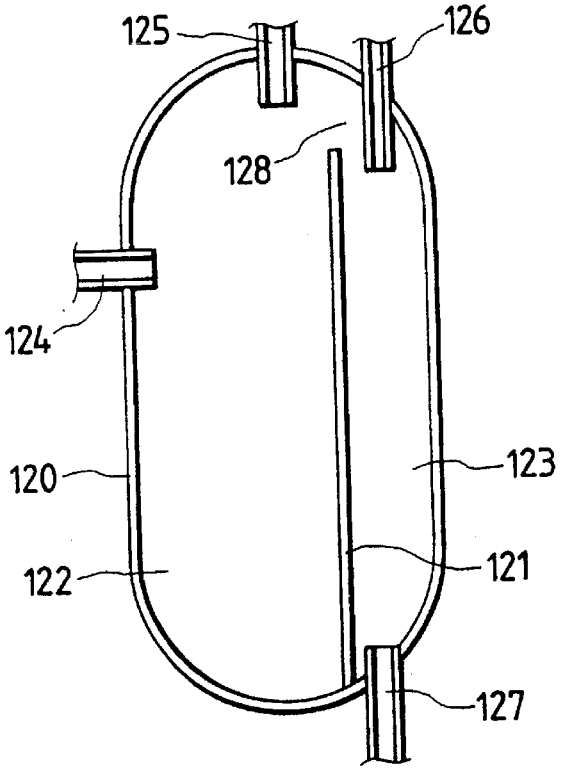
FIG. 14 is a sectional side view of a longitudinally mounted accumulator of a refrigerant circuit outdoor machine according to embodiment 9 of the invention.

Embodiment 9:

The refrigerant circuit outdoor machine accumulator shown in FIGS. 12A and 12B are of landscape or transversely mounted type, but that of portrait or longitudinally mounted type as shown in FIG. 14 also exhibits similar functions.

Figure 15:
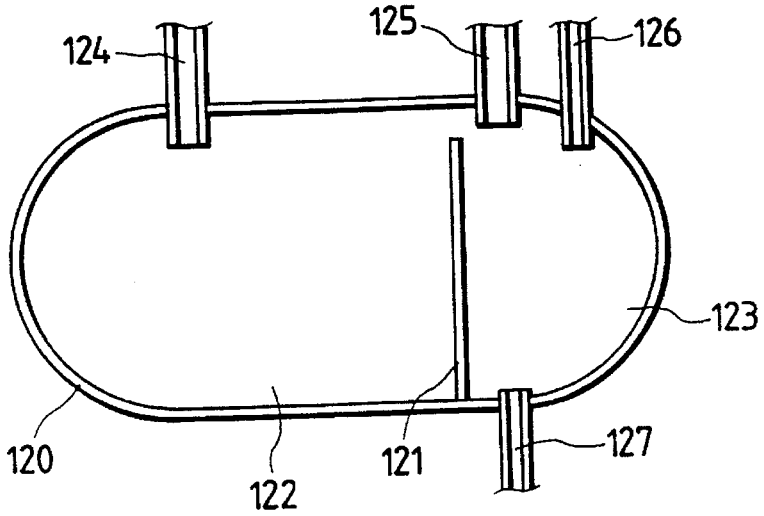
FIG. 15 is a sectional side view of a transversely mounted accumulator of a refrigerant circuit outdoor machine according to embodiment 10 of the invention.

Embodiment 10:

The effluent pipe 125 is disposed on the top of the first chamber 122 of the accumulator 120 in the embodiment shown in FIGS. 12A and 12B, but may be disposed in the second chamber 123 as shown in FIG. 15. If the structure as in FIG. 15 is adopted, the pressure loss from the evaporator 5 to the compressor 1 increases as much as a refrigerant passing through a communication hole 128 made in a partition plate 121. However, even if an excess refrigerant overflows the first chamber through the communication hole 128 for some fault, it accumulates in the second chamber for a while. Even if such fault occurs, such trouble that sudden return of a large amount of liquid refrigerant to the compressor 1 causes damage to the compressor 1 can be prevented.

Figure 16A:
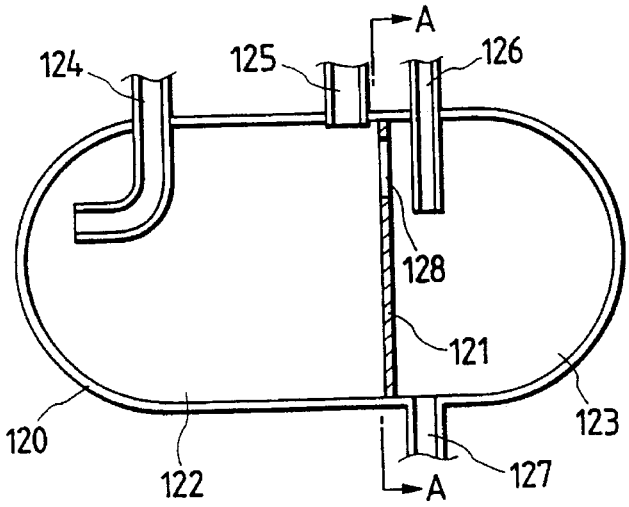
FIG. 16A is a sectional side view of an accumulator of a refrigerant circuit outdoor machine according to embodiment 11 of the invention.
Figure 16B:
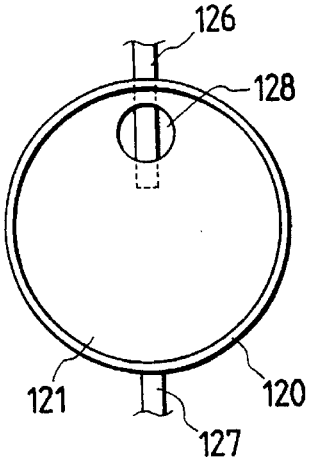
FIG. 16B is a cross sectional view at A—A line of FIG. 16A.

Embodiment 11:

FIG. 16A is a sectional side view of an accumulator of a refrigerant circuit outdoor machine according to an eleventh embodiment of the invention, and FIG. 16B is a cross sectional view at A—A line of FIG. 16A. The eleventh embodiment basically is the same as the eighth embodiment is components; the positional relationships among the components are defined in the eleventh embodiment. In FIGS. 16A and 16B, numeral 120 is an accumulator vessel and numeral 121 is a partition plate for partitioning off the accumulator vessel into two chambers; in the embodiment, a round communication hole 128 is made in the top of the partition plate 121. Numeral 122 is a first chamber, numeral 123 is a second chamber, numeral 124 is a refrigerant inflow pipe disposed in the first chamber 122 and having an inflow port positioned lower than the communication hole 128, an numeral 125 is a refrigerant effluent pipe disposed between the refrigerant inflow pipe 124 and the partition plate 121 and having a pipe end positioned near the partition plate 121 and scarcely projecting into the accumulator vessel 120. The refrigerant effluent pipe 125 and the refrigerant inflow pipe 124 are spaced from each other at least more than the diameter of the refrigerant inflow pipe 124. Numeral 126 is an oil inflow pipe disposed in the second chamber 123 and having an inflow port positioned lower than the communication hole 128 and numeral 127 is an oil effluent pipe disposed at the bottom of the second chamber 123.

Next, the function when the accumulator of the eleventh embodiment is used will be discussed. Flows of a refrigerant and oil are the same as those in the accumulator of the eighth embodiment and therefore will not be discussed again. In the eleventh embodiment, the refrigerant inflow pipe 124 is positioned as described above, thereby preventing liquid refrigerant from flowing directly into the second chamber 123 from the refrigerant inflow pipe 124 and the oil concentration in the second chamber 123 from being thinned. Also, the oil inflow pipe 126 is positioned as described above, thereby preventing oil from flowing directly into the first chamber 122 from the oil inflow pipe 126; oil is smoothly returned to the compressor. Since the liquid level of the liquid refrigerant accumulated in the first chamber 122 and the refrigerant effluent pipe 125 are kept apart and the refrigerant inflow pipe 124 and the refrigerant effluent pipe 125 are kept apart, the liquid refrigerant flowing directly out of the refrigerant inflow pipe 124 can be prevented from flowing into the refrigerant effluent pipe 125. Therefore, the vapor and liquid separation efficiency in the first chamber 122 can be improved. Since the refrigerant effluent pipe 125 and the communication hole 128 have the above-mentioned positional relationship, when some error occurs and the first chamber 122 is filled with liquid refrigerant, the liquid refrigerant can escape to the second chamber 123 without directly returning it to the compressor 1.

Preferably, all of tile positional relationship between the pipe ends of the refrigerant inflow pipe 124 and the oil inflow pipe 126 and tile lower end of the communication hole 128, the distance relationship between the refrigerant inflow and effluent pipes 124 and 125, the position of the lower end of the refrigerant effluent pipe 125, etc., are provided. However, if some are properly selected from among them, the function and effect can be provided as a matter of course.

Figure 17:
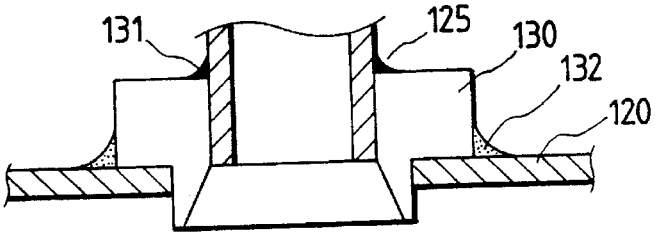
FIG. 17 is an enlarged sectional side view showing the structure of a refrigerant effluent pipe part of embodiment 11 of the invention.

FIG. 17 is a sectional view showing detailed connection of the refrigerant effluent pipe 125 to the accumulator 120 in FIGS. 16A and 16B, wherein numeral 120 is the accumulator, numeral 125 is the refrigerant inflow pipe, and numeral 130 is a boss previously brazed together with the refrigerant effluent pipe 125 (brazed part 131). The boss 130 has an entrance largely chamfered and the refrigerant effluent pipe 125 is brazed (brazed part 131) above the chamfer. The boss 130 integral with the refrigerant effluent pipe 125 is welded (welded part 132) into the accumulator 120.

As shown in the figure, if the refrigerant effluent pipe 125 is fitted to the accumulator 120, the liquid level of the liquid refrigerant accumulated in the first chamber 122 and the refrigerant effluent pipe 125 can be kept apart from each other to the maximum and the boss 130 projects into the inner face of the accumulator vessel 120, preventing liquid refrigerant from flowing into the refrigerant effluent pipe 125 along the inner wall of the accumulator vessel 120. Further, since the entrance of the boss 130 is chamfered, vapor refrigerant smoothly passes through the refrigerant effluent pipe 125 and the pressure loss is also small.

Figure 18:
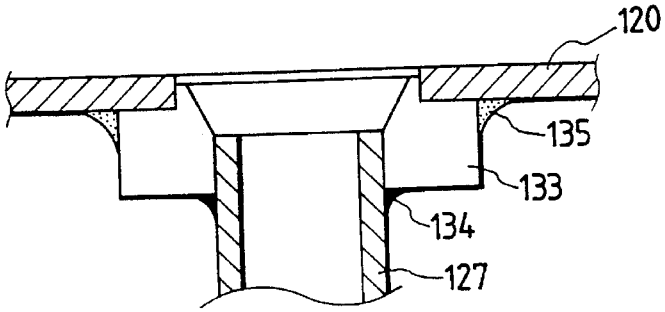
FIG. 18 is an enlarged sectional side view showing the structure of an oil effluent pipe part of embodiment 11 of the invention.

Likewise, FIG. 18 is a sectional view showing connection of the oil effluent pipe 127 to the accumulator 120 in FIGS. 16A and 16B, wherein numeral 120 is the accumulator, numeral 127 is the oil inflow pipe, and numeral 133 is a boss previously brazed together with the oil effluent pipe 127 (brazed part 134). The boss 133 has an entrance largely chamfered and the oil effluent pipe 127 is brazed (brazed part 134) below the chamfer. The boss 133 integral with the oil effluent pipe 127 is welded (welded part 135) into the accumulator 120.

As shown in the figure, if the oil effluent pipe 127 is fitted to the accumulator 120, the oil accumulated in the second chamber 123 flows reliably to the oil effluent pipe 127 and the boss 133 does not project into the inner face of the accumulator vessel 120, preventing oil from remaining on the bottom of the second chamber 123. Further, since the entrance of the boss 133 is chamfered, oil smoothly passes through the oil effluent pipe 127 and the flow loss is also small.

Figure 19:
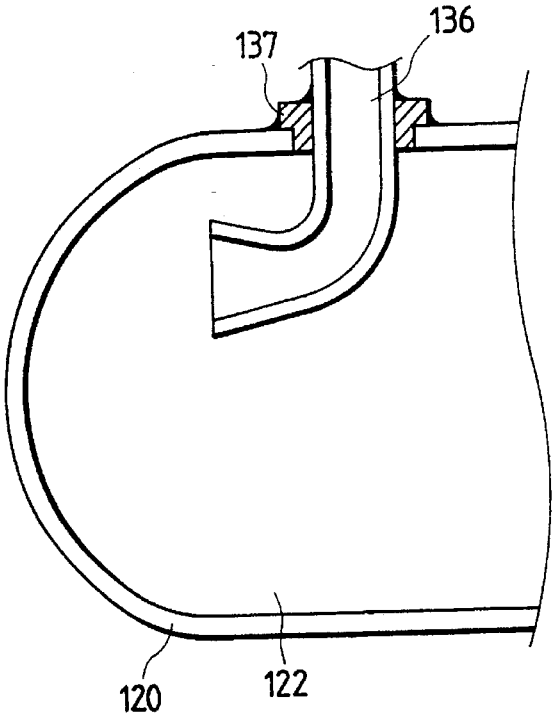
FIG. 19 is a sectional side view of a refrigerant inflow pipe part of an accumulator according to embodiment 12 of the invention.

Embodiment 12:

FIG. 19 is a sectional side view of a refrigerant inflow pipe part of an accumulator of a refrigerant circuit outdoor machine according to a twelfth embodiment of the invention, wherein numeral 136 is a refrigerant inflow pipe having a pipe end widening like a trumpet, numeral 137 is a boss for fixing the refrigerant inflow pipe 136 to the vessel of an accumulator 120, and numeral 122 is a first chamber of the accumulator 120. The refrigerant inflow pipe 136 is fixed to the boss 137 by brazing, etc., and a hole of the accumulator 120 vessel into which the boss 137 is fitted has a diameter set so as to allow insertion of the refrigerant inflow pipe 136 bent like a trumpet. The boss 137 integral with the refrigerant inflow pipe 136 is fixed to the accumulator 120 vessel by welding, etc.

In FIG. 19, the refrigerant inflow pipe 136 having the pipe end widening like a trumpet is adopted, whereby the speed of flowing-in liquid refrigerant is dropped, preventing refrigerant liquid from splashing at the refrigerant inflow pipe 136 and reducing the amount of refrigerant bouncing off the inner face of the accumulator vessel for improving the vapor and liquid separation efficiency.

Figure 20:
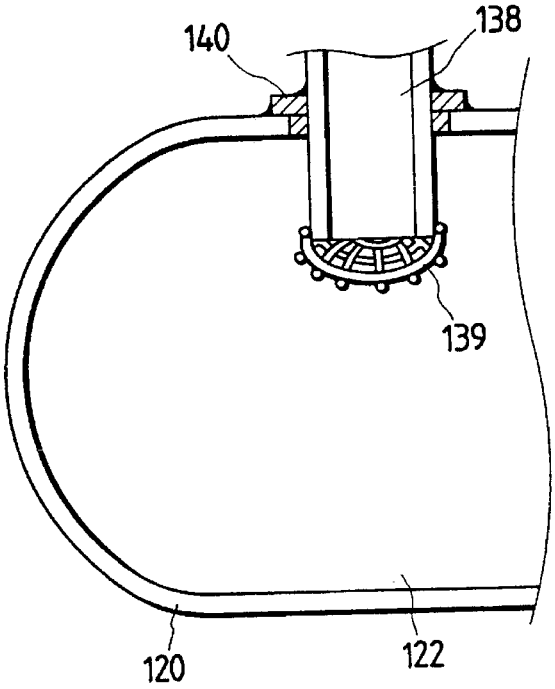
FIG. 20 is a sectional side view of a refrigerant inflow pipe part of an accumulator according to embodiment 13 of the invention.

Embodiment 13:

FIG. 20 shows a thirteenth embodiment of the invention providing a similar function and effect to those of the twelfth embodiment, wherein numeral 138 is a refrigerant inflow pipe, numeral 139 is a wire net of fine meshes fitted to the tip of the refrigerant inflow pipe 138, numeral 140 is a boss for fixing the refrigerant inflow pipe 138 to an accumulator 120 vessel, and numeral 122 is a first chamber of the accumulator 120. The refrigerant inflow pipe 138 is fixed to the boss 140 by brazing, etc., and a hole of the accumulator 120 vessel into which the boss 140 is fitted has a diameter set so as to allow insertion of the refrigerant inflow pipe 138 with the wire net 139 fixed to the tip of the pipe 138 by spot welding, etc. The boss 140 integral with the refrigerant inflow pipe 138 to which the wire net 139 is fixed is fixed to the accumulator 120 vessel by welding, etc.

In FIG. 20, the wire net 139 is fitted to the tip of the refrigerant inflow pipe 138 and the flow speed of flowing-in refrigerant is lowered by the wire net 139 as resistance. Thus, the pressure loss increases, but the speed of flowing-in liquid refrigerant lowers, preventing refrigerant liquid from splashing at the refrigerant inflow pipe 138 and improving the vapor and liquid separation efficiency.

Figure 21:
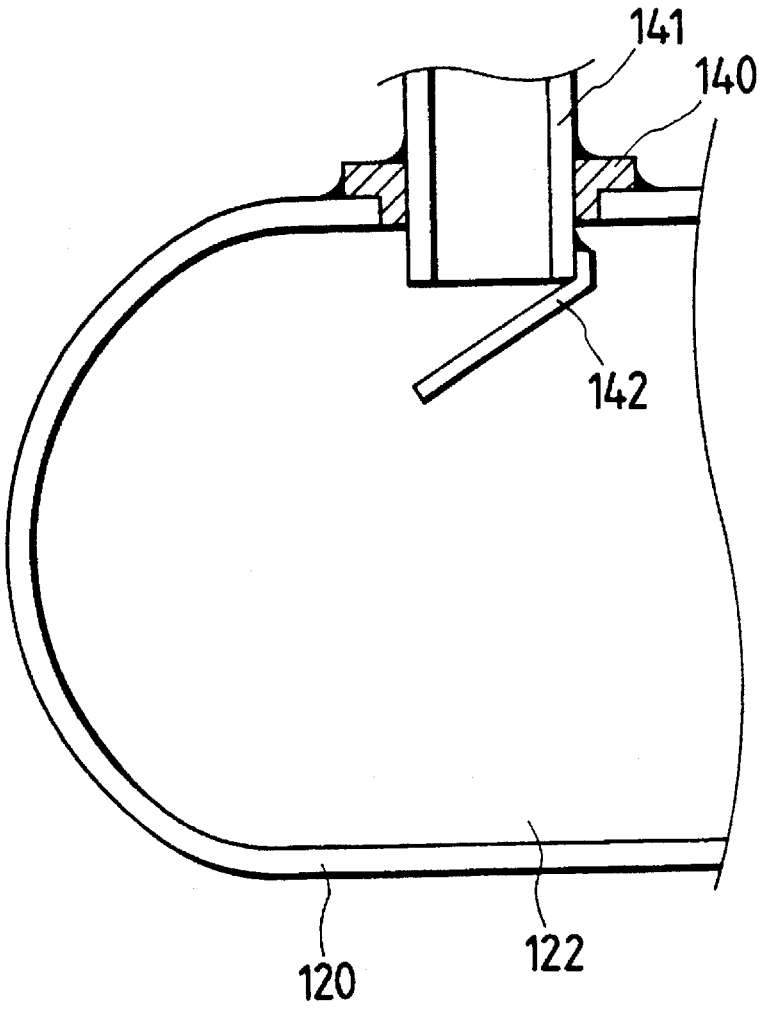
FIG. 21 is a sectional side view of a refrigerant inflow pipe part of an accumulator according to embodiment 14 of the invention.

Embodiment 14:

FIG. 21 shows a fourteenth embodiment of the invention providing a similar function and effect to those of the twelfth and thirteenth embodiments, wherein numeral 141 is a refrigerant inflow pipe, numeral 142 is a plate fitted to the tip of the refrigerant inflow pipe 141, numeral 140 is a boss for fixing the refrigerant inflow pipe 141 to an accumulator 120 vessel, and numeral 122 is a first chamber of the accumulator 120. The refrigerant inflow pipe 141 is fixed to the boss 140 by brazing, etc., and a hole of the accumulator 120 vessel into which the boss 140 is fitted has a diameter set so as to allow insertion of the refrigerant inflow pipe 141 with the plate 142 fixed to the tip of the pipe 138 by spot welding, etc. The boss 140 integral with the refrigerant inflow pipe 141 to which the plate 142 is fixed is fixed to the accumulator 120 vessel by welding, etc.

In FIG. 21, flowing-in refrigerant once collides with the plate 142 fitted to the tip of the refrigerant inflow pipe 141 and loses its speed because of the collision. Thus, the pressure loss increases, but the amount of refrigerant bouncing off the inner face of the accumulator vessel is reduced for improving the vapor and liquid separation efficiency.

Thus, the refrigerant inflow speed reduction unit for lowering the flow speed of refrigerant into the refrigerant inflow pipe is provided in the twelfth to fourteenth embodiments, whereby refrigerant liquid is prevented from splashing at the refrigerant inflow pipe 138 and the amount of refrigerant bouncing off the inner face of the accumulator vessel is reduced for improving the vapor and liquid separation efficiency. In addition, if a mechanism for dropping the refrigerant inflow speed is provided, a similar effect is produced.

Figure 22A:
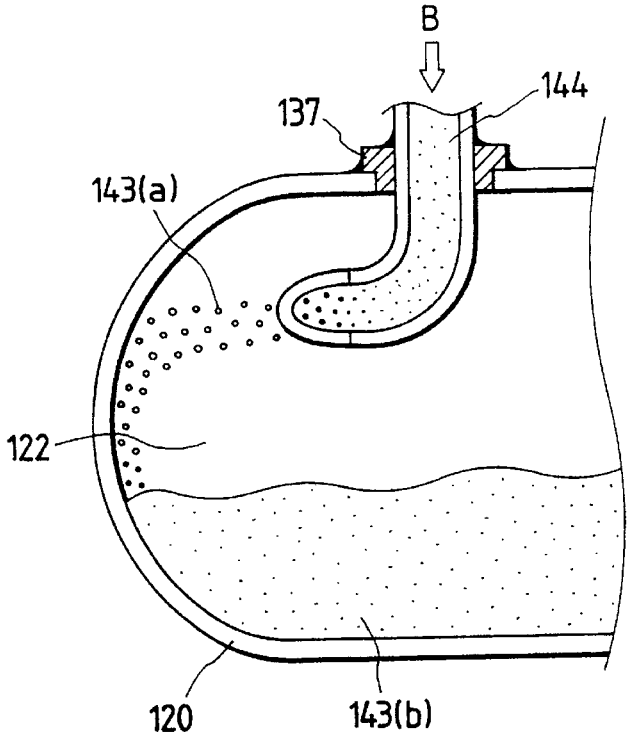
FIG. 22A is a sectional side view of a refrigerant inflow pipe part of an accumulator according to embodiment 15 of the invention.
Figure 22B:
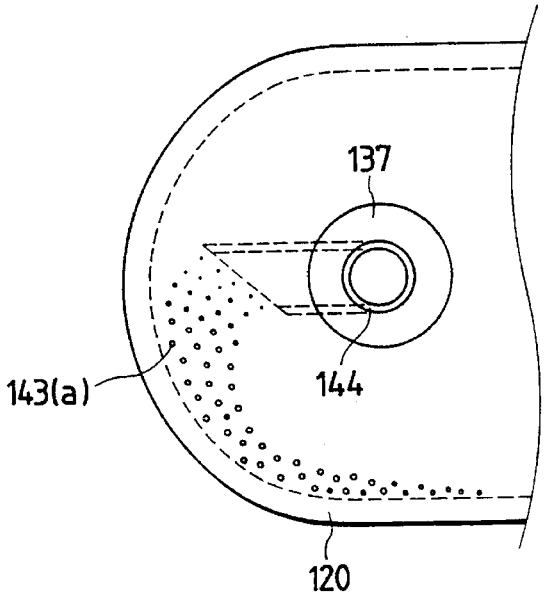
FIG. 22B is a view from B direction of FIG. 22A.

Embodiment 15:

FIG. 22A is a sectional side view of a refrigerant inflow pipe part of an accumulator of a refrigerant circuit outdoor machine according to a fifteenth embodiment of the invention. (See FIG. 12A or 16A for the entire view of the accumulator.) FIG. 22B shows the refrigerant inflow pipe part of the accumulator viewed from the B direction. In FIGS. 22A and 22B, numeral 120 is an accumulator, numeral 122 is a first chamber, numeral 144 is a refrigerant inflow pipe inserted into the accumulator 120, bent in a direction opposed to a partition plate 121 (not shown), and having a tip cut slantingly, numeral 137 is a boss for fixing the refrigerant inflow pipe 144 to the accumulator 120 vessel, numeral 143 (a) is a liquid drop of flowing-in refrigerant, and numeral 143 (b) is a liquid refrigerant accumulated in the first chamber 122.

In the embodiment, the tip of the refrigerant inflow pipe 144 is cut slantingly, thereby increasing the sectional area of the exit of the refrigerant inflow pipe 144 for reducing the speed of the liquid drops 143 (a) of flowing-in refrigerant. Further, since the tip of the refrigerant inflow pipe 144 is cut slantingly, the inflow direction is made slant due to viscosity of the refrigerant itself and the refrigerant flows along the wall in the accumulator 120 vessel. Thus, the speed of the liquid drops 143 (a) of the flowing-in refrigerant is reduced, thereby absorbing refrigerant bouncing off the wall of the accumulator 120 and causing a flow in the accumulator 120 vessel, thereby preventing the liquid drops 143 (a) from splashing and stabilizing the liquid level of the refrigerant 143 (b) accumulated in the first chamber 122 for improving the vapor and liquid separation efficiency in the first chamber 122.

Figure 23A:
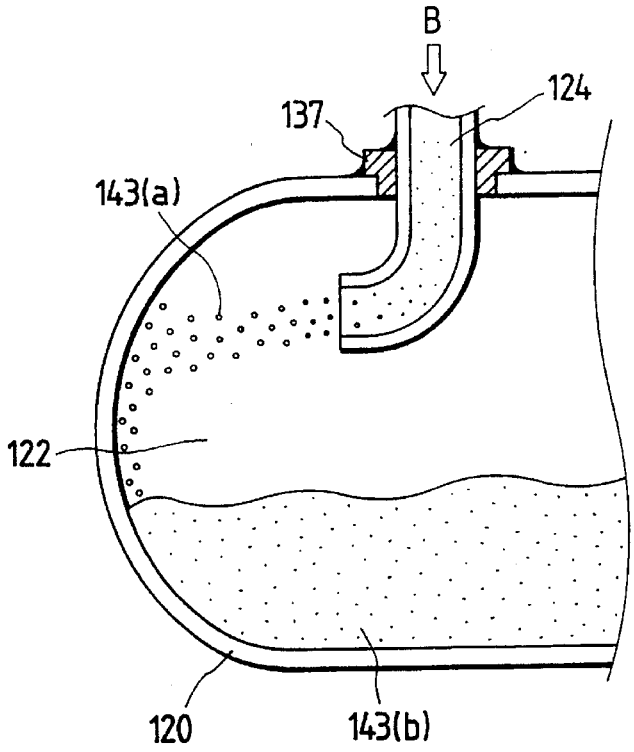
FIG. 23A is a sectional side view of a refrigerant inflow pipe part of an accumulator according to embodiment 16 of the invention.
Figure 23B:
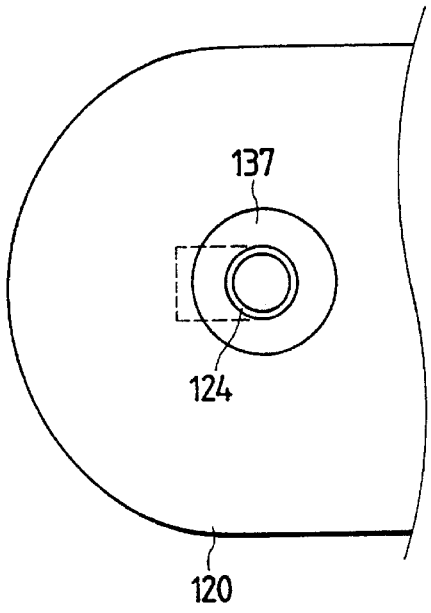
FIG. 23B is a view from B direction of FIG. 23A.

Embodiment 16:

FIG. 23A is a sectional side view of a refrigerant inflow pipe part of an accumulator of a refrigerant circuit outdoor machine according to a sixteenth embodiment of the invention. (See FIG. 12A or 16A for the entire view of the accumulator.) FIG. 23B shows the refrigerant inflow pipe part of the accumulator viewed from the B direction. In FIGS. 23A and 23B, numeral 120 is an accumulator, numeral 122 is a first chamber, numeral 124 is a refrigerant inflow pipe bent in a direction opposed to a partition plate 121 (not shown) disposed in the accumulator 120 and in parallel with the liquid level of liquid refrigerant 143 (b) accumulated in the first chamber 122, numeral 137 is a boss for fixing the refrigerant inflow pipe 124 to the accumulator 120 vessel, numeral 143 (a) is a liquid drop of flowing-in refrigerant, and numeral 143 (b) is liquid refrigerant accumulated in the first chamber 122.

The refrigerant inflow pipe 124 is thus formed and placed, whereby the liquid drops 143 (a) of refrigerant do not directly flow into a refrigerant effluent pipe 125 or a communication hole 128 of the partition plate 121. Therefore, the vapor and liquid separation efficiency in the first chamber 122 is improved and the refrigerant directly flowing into a second chamber 123 can also be reduced, preventing the oil concentration in the second chamber 123 from being thinned. The liquid drops 143 (a) flow along the shell wall in the accumulator 120. Such a flow is caused in the accumulator 120 vessel, thereby absorbing refrigerant bouncing off the wall of the accumulator 120, preventing the liquid drops 143 (a) from splashing, and stabilizing the liquid level of the refrigerant 143 (b) accumulated in the first chamber 122 for improving the vapor and liquid separation efficiency in the first chamber 122.

Figure 24A:
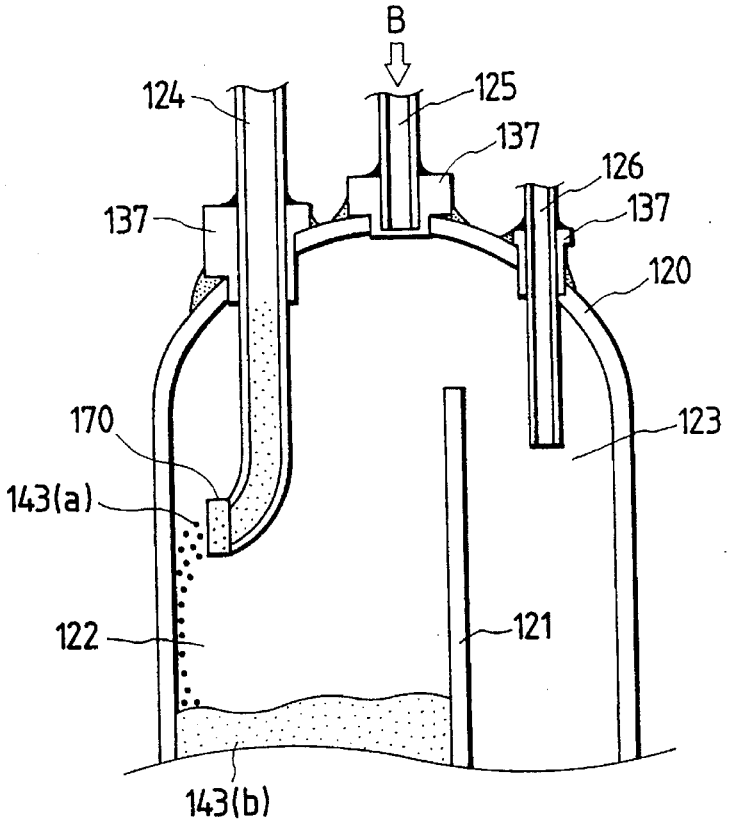
FIG. 24A is a sectional side view of a refrigerant inflow pipe part of a longitudinally mounted accumulator according to embodiment 17 of the invention.
Figure 24B:
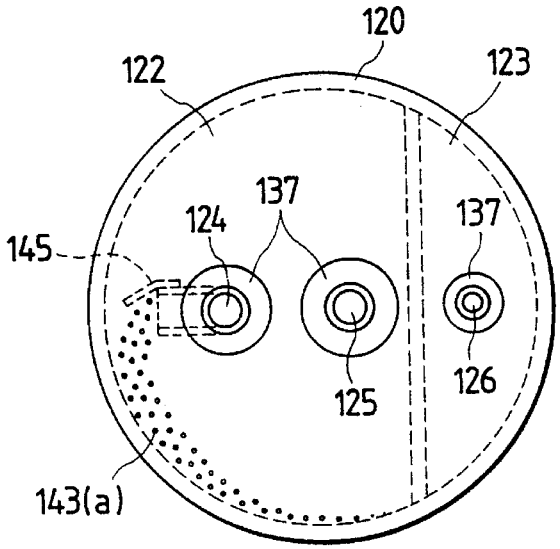
FIG. 24B is a view from B direction of FIG. 24A.

Embodiment 17:

FIG. 24A is a sectional side view of a refrigerant inflow pipe part of a longitudinally mounted accumulator of a refrigerant circuit outdoor machine according to a seventeenth embodiment of the invention. (See FIG. 14 for the entire view of the accumulator.) FIG. 24B shows the refrigerant inflow pipe part of the accumulator viewed from the B direction. In FIGS. 24A and 24B, numeral 120 is an accumulator, numeral 122 is a first chamber, numeral 123 is a second chamber, numeral 124 is a refrigerant inflow pipe inserted into the accumulator 120, bent in a direction opposed to a partition plate 121, and having a tip to which a slantingly bent plate 145 is fitted by spot welding, numeral 125 is a refrigerant effluent pipe, numeral 126 is an oil inflow pipe, numeral 137 is a boss for fixing the refrigerant inflow pipe 124, the refrigerant effluent pipe 125, and the oil inflow pipe 126 to the accumulator 120 vessel, numeral 143 (a) is a liquid drop of flowing-in refrigerant, and numeral 143 (b) is a liquid refrigerant accumulated in the first chamber 122.

In the embodiment, the tip of the refrigerant inflow pipe 124 is formed with the slantingly bent plate 145, whereby the inflow direction of the liquid drops 143 (a) of flowing-in refrigerant is changed to a slant direction and a flow is caused along the wall of the accumulator 120 as in the above-mentioned embodiment, producing a similar effect. In the seventeenth embodiment, the longitudinally mounted accumulator has been discussed, but a transversely mounted accumulator produces a similar effect. If the refrigerant inflow pipe 144 having the slantingly cut tip is applied to the longitudinally mounted accumulator, a similar effect is produced.

Figure 25A:
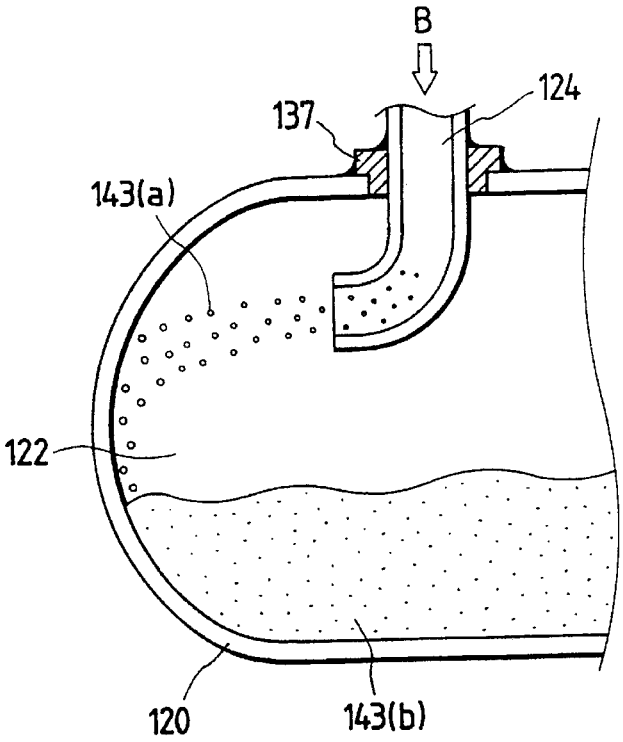
FIG. 25A is a sectional side view of a refrigerant inflow pipe part of an accumulator according to embodiment 18 of the invention.
Figure 25B:
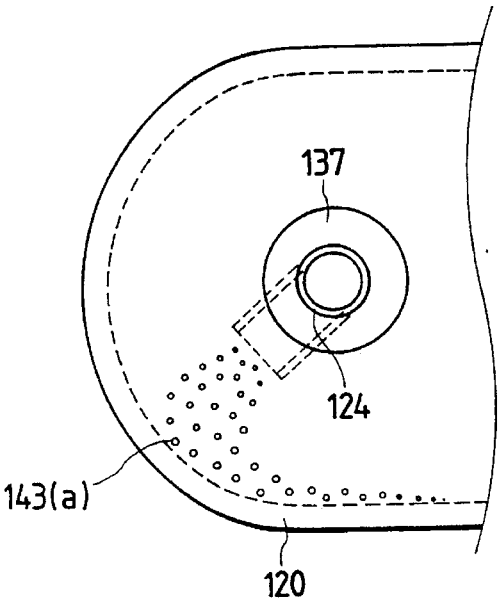
FIG. 25B is a view from B direction of FIG. 25A.

Embodiment 18:

FIG. 25A is a sectional side view of a refrigerant inflow pipe part of a transversely mounted accumulator of a refrigerant circuit outdoor machine according to an eighteenth embodiment of the invention. (See FIG. 12A or 16A for the entire view of the accumulator.) FIG. 25B shows the refrigerant inflow pipe part of the accumulator viewed from the B direction. In FIGS. 25, numeral 120 is an accumulator, numeral 122 is a first chamber, numeral 124 is a refrigerant inflow pipe inserted into the accumulator 120, bent in a direction opposed to a partition plate 121 (not shown), and having a tip pointed toward the shoulder of the accumulator 120, numeral 137 is a boss for fixing the refrigerant inflow pipe 124 to the accumulator 120 vessel, numeral 143 (a) is a liquid drop of flowing-in refrigerant, and numeral 143 (b) is a liquid refrigerant accumulated in the first chamber 122.

In the embodiment, since the refrigerant inflow pipe 124 is bent in the direction opposed to the partition plate 121 and has the tip pointed toward the shoulder of the accumulator 120, the liquid drops 143 (a) of refrigerant flow along the wall of the accumulator 120 vessel. Such a flow is caused in the accumulator 120 vessel, thereby absorbing refrigerant bouncing off the wall of the accumulator 120, preventing the liquid drops 143 (a) from splashing, and stabilizing the liquid level of the refrigerant 143 (b) accumulated in the first chamber 122 for improving the vapor and liquid separation efficiency in the first chamber 122. Further, since the liquid drops 143 (a) of refrigerant do not directly flow into a refrigerant effluent pipe 125 or a communication hole 128 of the partition plate 121, the vapor and liquid separation efficiency in the first chamber 122 is improved and the refrigerant directly flowing into a second chamber 123 can also be reduced.

Figure 26A:
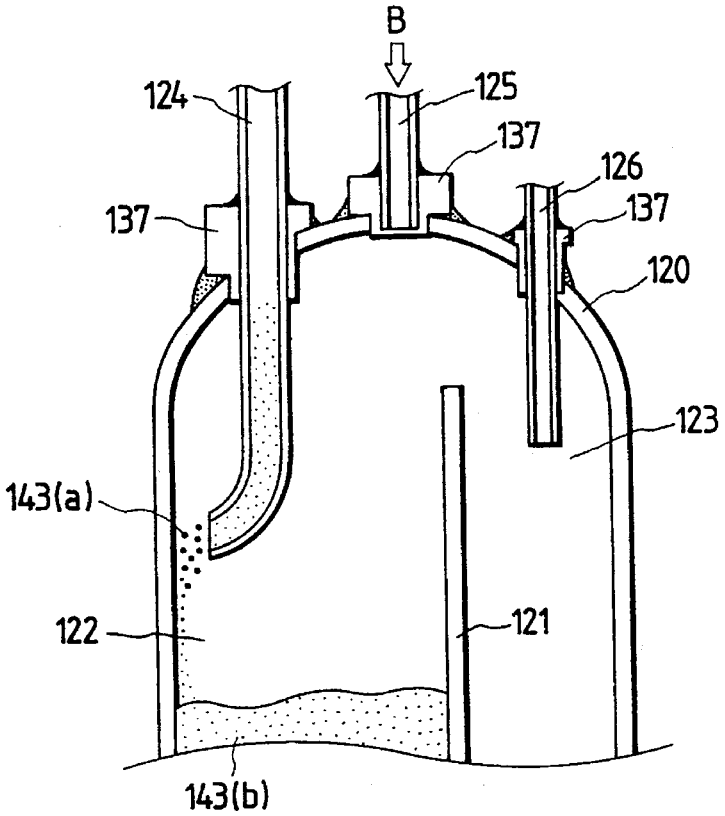
FIG. 26A is a sectional side view of a refrigerant inflow pipe part of a longitudinally mounted accumulator according to embodiment 19 of the invention.
Figure 26B:
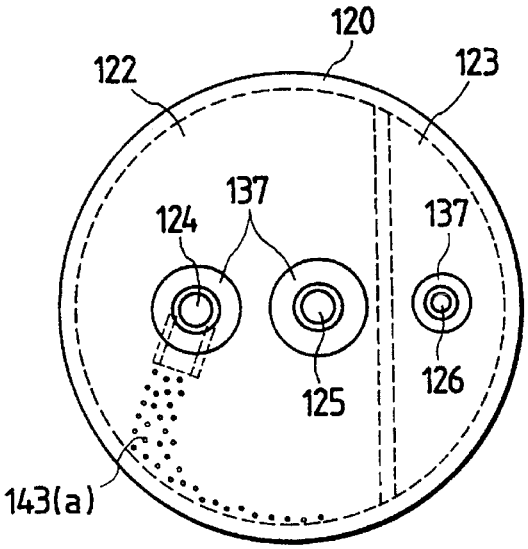
FIG. 26B is a view from B direction of FIG. 26A.

Embodiment 19:

FIG. 26A is a sectional side view of a refrigerant inflow pipe part of a longitudinally mounted accumulator of a refrigerant circuit outdoor machine according to a nineteenth embodiment of the invention. (See FIG. 14 for the entire view of the accumulator.) FIG. 26B shows the refrigerant inflow pipe part of the accumulator viewed from the B direction. In FIGS. 26A and 26B, numeral 120 is an accumulator, numeral 122 is a first chamber, numeral 123 is a second chamber, numeral 124 is a refrigerant inflow pipe inserted into the accumulator 120, bent in a direction opposed to a partition plate 121, and having a tip pointed toward the tangent direction of the inner wall of the accumulator 120, numeral 125 is a refrigerant effluent pipe, numeral 126 is an oil inflow pipe, numeral 137 is a boss for fixing the refrigerant inflow pipe 124, the refrigerant effluent pipe 125, and the oil inflow pipe 126 to the accumulator 120 vessel, numeral 143 (a) is a liquid drop of flowing-in refrigerant, and numeral 143 (b) is a liquid refrigerant accumulated in the first chamber 122.

In the embodiment, since the refrigerant inflow pipe 124 is bent in the direction opposed to the partition plate 121 and has the tip pointed toward the tangent direction of the accumulator 120, the inflow direction of the liquid drops 143 (a) of flowing-in refrigerant becomes slant and a flow is caused along the wall of the accumulator 120 as in the above-mentioned embodiment, producing a similar effect.

Figure 27A:
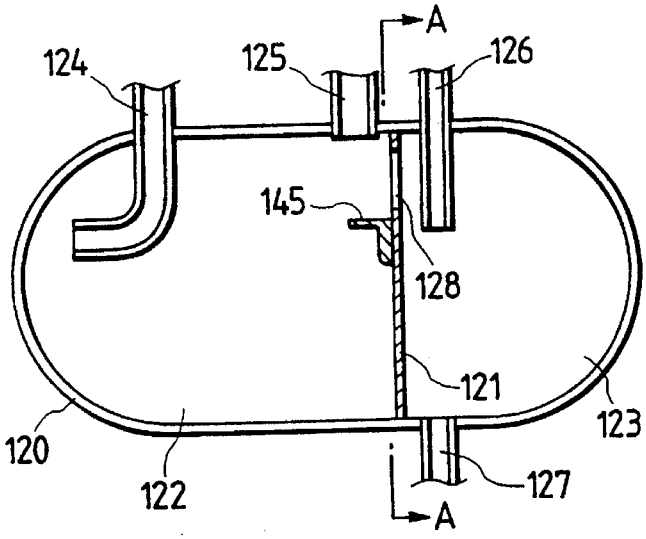
FIG. 27A is a sectional side view of an accumulator of a refrigerant circuit outdoor machine according to embodiment 20 of the invention.
Figure 27B:
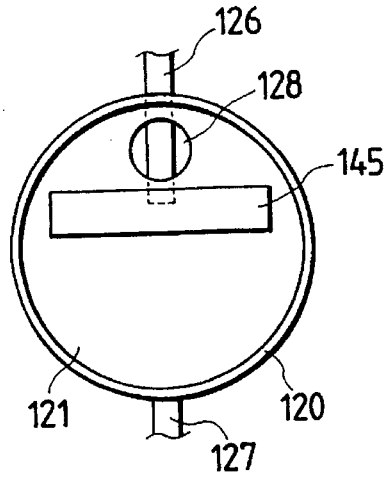
FIG. 27B is a cross sectional view at A—A line of FIG. 27A.

Embodiment 20:

FIG. 27A is a sectional side view of an accumulator of a refrigerant circuit outdoor machine according to a twentieth embodiment of the invention. FIG. 27B is a cross sectional view at A—A line of FIG. 27A. Components identical with or similar to those previously described with reference to FIGS. 12A and 12B are denoted by the same reference numerals in FIGS. 27A and 27B. Numeral 120 is an accumulator vessel and numeral 121 is a partition plate for partitioning off the accumulator vessel into two chambers; in the embodiment, a round communication hole 128 is made in the top of the partition plate 121. Numeral 145 is a refrigerant shutoff plate, liquid refrigerant transfer prevention unit disposed below the communication hole 128 of the partition plate 121, numeral 122 is a first chamber, numeral 123 is a second chamber, numeral 124 is a refrigerant inflow pipe disposed in the first chamber 122, numeral 125 is a refrigerant effluent pipe, numeral 126 is an oil inflow pipe disposed in the second chamber 123, and numeral 127 is an oil effluent pipe disposed at the bottom of the second chamber 123.

In the embodiment, the refrigerant shutoff plate 145, which is disposed below the communication hole 128 of the partition plate 121, prevents liquid drops of refrigerant 143 (a) spouted from the first chamber 122 from directly flowing into the second chamber 123, thereby preventing the oil concentration in the second chamber 123 from lowering.

Figure 28A:
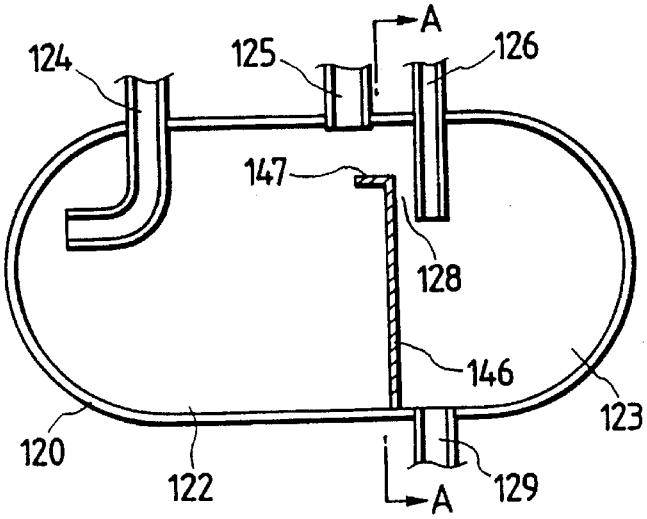
FIG. 28A is a sectional side view of an accumulator of a refrigerant circuit outdoor machine according to embodiment 21 of the invention.
Figure 28B:
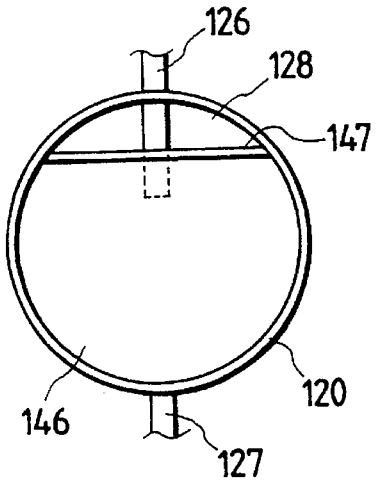
FIG. 28B is a cross sectional view at A—A line of FIG. 28A.

Embodiment 21:

FIG. 28A is a sectional side view of an accumulator of a refrigerant circuit outdoor machine according to a twenty-first embodiment of the invention. FIG. 28B is a cross sectional view at A—A line of FIG. 28A. Components identical with or similar to those previously described with reference to FIGS. 12A and 12B are denoted by the same reference numerals in FIGS. 28A and 28B. Numeral 120 is an accumulator vessel and numeral 146 is a partition plate for partitioning off the accumulator vessel into two chambers; a communication hole 128 is notched and the notch member 147 is bent to the side of a first chamber 122, whereby liquid refrigerant transfer prevention unit is provided. Numeral 123 is a second chamber, numeral 124 is a refrigerant inflow pipe disposed in the first chamber 122, numeral 125 is a refrigerant effluent pipe, numeral 126 is an oil inflow pipe disposed in the second chamber 123, and numeral 127 is an oil effluent pipe disposed at the bottom of the second chamber 123.

In the embodiment, tile communication hole 128 of the partition plate 146 is notched and the notch member 147 is bent to the side of the first chamber 122, whereby liquid refrigerant transfer prevention unit, which serves as the refrigerant shutoff plate 145 in the twentieth embodiment, is provided for preventing liquid drops of refrigerant 143 (a) spouted from the first chamber 122 from directly flowing into the second chamber 123, thereby preventing the oil concentration in the second chamber 123 from lowering.

Figure 29A:
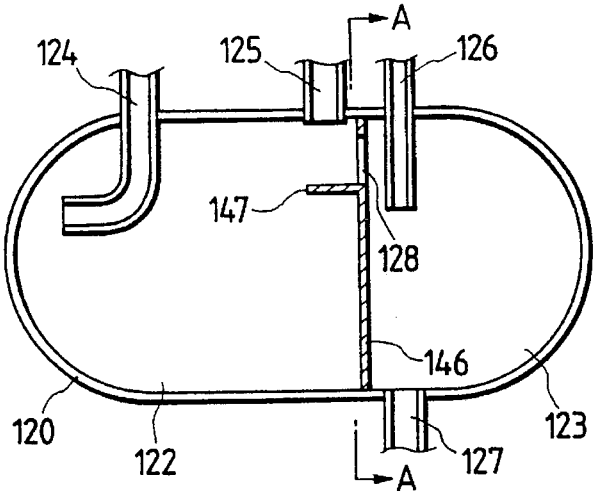
FIG. 29A is a sectional side view of an accumulator of a refrigerant circuit outdoor machine according to embodiment 22 of the invention.
Figure 29B:
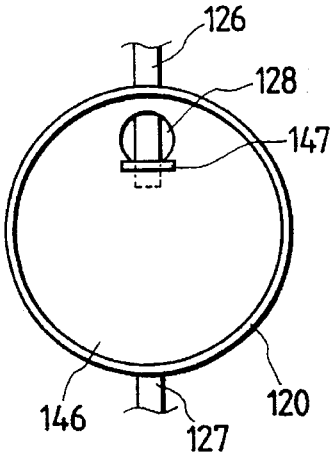
FIG. 29B is a cross sectional view at A—A line of FIG. 29A.

Embodiment 22:

FIG. 29A is a sectional side view of an accumulator of a refrigerant circuit outdoor machine according to a twenty-second embodiment of the invention and FIG. 29B is a cross sectional view at A—A line of FIG. 29A, wherein a communication hole 128 of a partition plate 147 is round. The communication hole 128 is notched like a round hole and the notch member 147 is bent to the side of a first chamber 122, whereby liquid refrigerant transfer unit is provided. According to the method, simple working is enabled with a press and productivity is improved.

The function is similar to that in the twenty-first embodiment; liquid drops of refrigerant 143 (a) spouted from the first chamber 122 are prevented from directly flowing into the second chamber 123, thereby preventing the oil concentration in the second chamber 123 from lowering.

Figure 30A:
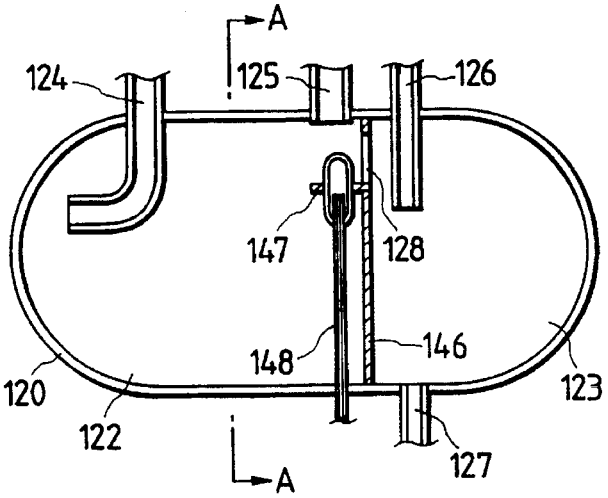
FIG. 30A is a sectional side view of an accumulator of a refrigerant circuit outdoor machine according to embodiment 23 of the invention.
Figure 30B:
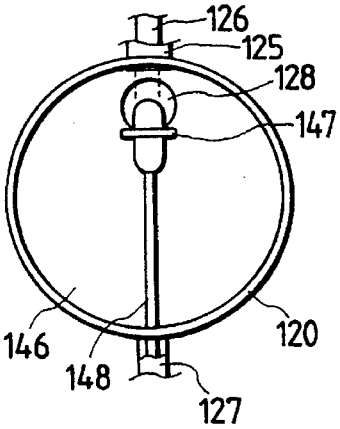
FIG. 30B is a cross sectional view at A—A line of FIG. 30A.
Figure 30C:
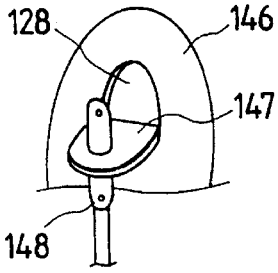
FIG. 30C is a partial enlarged view of FIG. 30A.

Embodiment 23:

FIG. 30A is a sectional side view of an accumulator of a refrigerant circuit outdoor machine according to a twenty-third embodiment of the invention. In addition, FIG. 30B is a cross sectional view at A—A line of FIG. 30B, and FIG. 30C is a partial enlarged view of FIG. 30A. Components identical with or similar to those previously described with reference to FIGS. 29A and 29B are denoted by the same reference numerals in FIG. 30A. Numeral 120 is an accumulator vessel and numeral 146 is a partition plate for partitioning off the accumulator vessel into two chambers; a communication hole 128 is notched like a round hole and the notch member 147 is bent to the side of a first chamber 122. The notch member 147 is formed with a hole into which an upper liquid level sensing pipe 148 for sensing that accumulated refrigerant overflows the first chamber 122 is fitted. The upper liquid level sensing pipe 148 is fitted into the hole by spot welding, etc. Numeral 123 is a second chamber, numeral 124 is a refrigerant inflow pipe disposed in the first chamber 122, numeral 125 is a refrigerant effluent pipe, numeral 126 is an oil inflow pipe disposed in the second chamber 123, and numeral 127 is an oil effluent pipe disposed at the bottom of the second chamber 123.

The embodiment is applied when a sensor for sensing that accumulated refrigerant overflows the first chamber 122 is provided in the accumulator 120. The communication hole 128 of the partition plate 146 is notched, the notch member 147 is bent to the side of the first chamber 122, and the upper liquid level sensing pipe 148 is fitted into the bent member 147. The upper liquid level sensing pipe 148 comprises a heater (not shown) and a thermistor (not shown) for measuring a pipe surface temperature at midpoints of the pipe. When a refrigerant flows into the liquid level sensing pipe 148, the flowing-in refrigerant is evaporated by the heater, heat being lost. Therefore, the pipe surface temperature observed at the thermistor lowers; this is used as a signal indicating that the refrigerant level rises to the top of the first chamber 122 of the accumulator 120. If the refrigerant accumulated in the accumulator is about to overflow the first chamber into the second chamber, the signal can be sued to stop the operation for protecting a compressor or be displayed on an indicator, etc., as a guide for discharging the refrigerant. Hitherto, a long pipe has been used for sensing the upper liquid level; there is a chance that vibration, etc., of liquid refrigerant 143 (b) accumulated in the first chamber 122 will cause damage to the upper liquid level sensing pipe 148. Since the long upper liquid level sensing pipe 148 can be fixed to the member 147 of the partition plate 146 serving as the detection section in the embodiment, there is no chance that vibration of liquid refrigerant 143 (b) accumulated in the first chamber 122 will cause damage to the upper liquid level sensing pipe 148.

If the upper liquid level sensing pipe 148 is fitted to the refrigerant shutoff plate 145 described in the twentieth embodiment, a similar function and effect are provided as a matter of course.

Figure 31A:
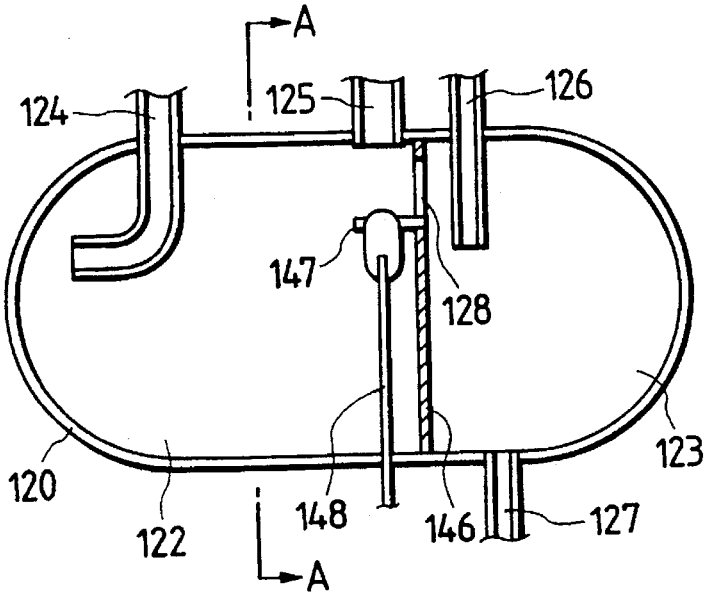
FIG. 31A is a sectional side view of an accumulator of a refrigerant circuit outdoor machine according to embodiment 24 of the invention.
Figure 31B:
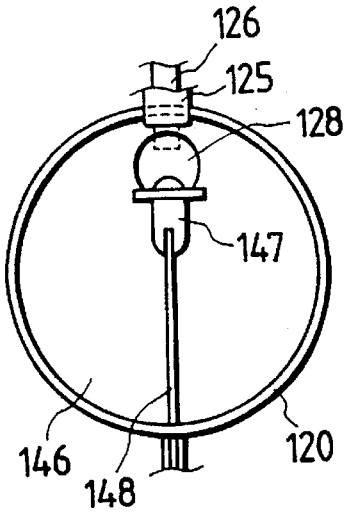
FIG. 31B is a cross sectional view at A—A line of FIG. 31A.

Embodiment 24:

FIG. 31A is a sectional side view of an accumulator of a refrigerant circuit outdoor machine according to a twenty-fourth embodiment of the invention, and FIG. 31A is a cross sectional view at A—A line of FIG. 31A. Components identical with or similar to those previously described with reference to FIG. 30A are denoted by the same reference numerals in FIGS. 31A and 3lB. Numeral 120 is an accumulator vessel and numeral 146 is a partition plate for partitioning off the accumulator vessel into two chambers; a communication hole 128 is notched like a round hole and the notch member 147 is bent to the side of a first chamber 122. Numeral 123 is a second chamber, numeral 124 is a refrigerant inflow pipe disposed in the first chamber 122, numeral 125 is a refrigerant effluent pipe, numeral 126 is an oil inflow pipe disposed in the second chamber 123, and numeral 148 is an upper liquid level sensing pipe disposed lower than the communication hole 148.

The embodiment is applied when a sensor for sensing whether or not refrigerant flows into the second chamber 123 from the first chamber 122 is provided in the accumulator 120; the upper liquid level sensing pipe 148 disposed in the first chamber 122 is used. The upper liquid level sensing pipe 148 is fitted to the notch member 147 so that it is placed lower than the communication hole 128, thereby sensing that bubbles occur on the liquid face in the first chamber 122 and flow into the second chamber 123.

Figure 32:
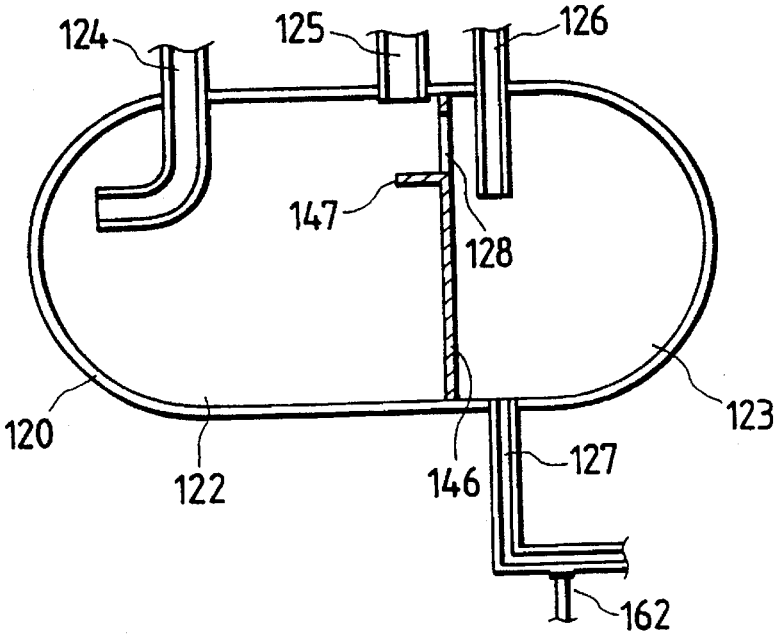
FIG. 32 is a sectional side view of an accumulator of a refrigerant circuit outdoor machine according to embodiment 25 of the invention.

Embodiment 25:

FIG. 32 is a sectional side view of an accumulator of a refrigerant circuit outdoor machine according to an twenty-fifth embodiment of the invention. Components identical with or similar to those previously described with reference to FIG. 30A are denoted by the same reference numerals in FIG. 32. Numeral 120 is an accumulator vessel and numeral 146 is a partition plate for partitioning off the accumulator vessel into two chambers; a communication hole 128 is notched like a round hole and the notch member 147 is bent to the side of a first chamber 122. Numeral 123 is a second chamber, numeral 124 is a refrigerant inflow pipe disposed in the first chamber 122, numeral 125 is a refrigerant effluent pipe, numeral 126 is an oil inflow pipe disposed in the second chamber 123, and numeral 127 is an oil effluent pipe disposed at the bottom of the second chamber 123. A temperature sensor is disposed at a midpoint of the pipe 127.

In the embodiment, a thermistor 162 for measuring a pipe surface temperature is disposed at a midpoint of the oil effluent pipe 127 for returning oil accumulated in the second chamber 123 to a compressor. When liquid refrigerant flows into the second chamber 123 from the first chamber 122, the pipe surface temperature observed at the thermistor 162 lowers, thereby sensing whether or not refrigerant flows into the second chamber. Thus, when the oil effluent pipe 127 in the second chamber 123 is provided with the temperature sensor, a similar function to the upper liquid level sensing pipe is provided.

Figure 33:
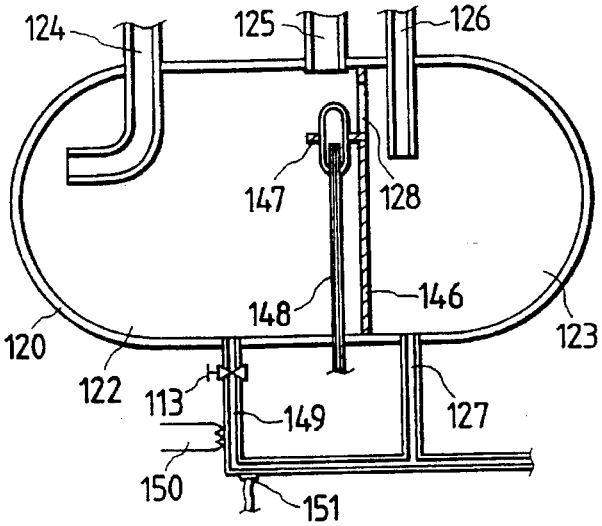
FIG. 33 is a sectional side view of an accumulator of a refrigerant circuit outdoor machine according to embodiment 26 of the invention.

Embodiment 26:

FIG. 33 is a sectional side view of an accumulator of a refrigerant circuit outdoor machine according to a twenty-sixth embodiment of the invention. Components identical with or similar to those previously described with reference to FIG. 30A are denoted by the same reference numerals in FIG. 33. Numeral 120 is an accumulator vessel and numeral 146 is a partition plate for partitioning off the accumulator vessel into two chambers; a communication hole 128 is notched like a round hole and the notch member 147 is bent to the side of a first chamber 122. Numeral 148 is an upper liquid level sensing pipe 148, numeral 123 is a second chamber, numeral 124 is a refrigerant inflow pipe disposed in the first chamber 122, numeral 125 is a refrigerant effluent pipe, numeral 126 is an oil inflow pipe disposed in the second chamber 123, and numeral 127 is an oil effluent pipe disposed at the bottom of the second chamber 123. Numeral 149 is a second oil effluent pipe disposed at the bottom of the first chamber 122 and communicated with a compressor 1. A midportion of the pipe is used as a lower liquid level sensing pipe. Numeral 150 is a heater for evaporating flowing-in refrigerant and numeral 151 is a thermistor fitted to the second oil effluent pipe 149; the heater 150 and the thermistor 151 make up a liquid level sensing circuit. Numeral 13 is a expansion device for controlling amounts of oil and refrigerant returned to the compressor.

The embodiment is applied when a sensor for sensing whether or nor refrigerant exists in the first chamber 122 is provided in the accumulator 120. The second oil effluent pipe 149 is disposed at the bottom of the first chamber 122 and a midportion of the pipe is used as a lower liquid level sensing pipe. Originally, the oil effluent pipe 149 is provided to return a small amount of oil accumulated in the first chamber 122 together with refrigerant to the compressor. A heater 150 and a thermistor 151 for measuring a pipe surface temperature are disposed at midpoints of the oil effluent pipe 149. When a refrigerant accumulates in the first chamber 122, the flowing-in refrigerant is evaporated by the heater 150, heat being lost. Therefore, the pipe surface temperature observed at the thermistor 151 lowers; this can be sued as a signal for sensing whether or not a refrigerant exists in the first chamber 122. If the signal senses that the accumulator becomes empty of refrigerant, the signal can be used to stop the operation for protecting the compressor or be displayed on an indicator, etc., as a guide for adding or discharging the refrigerant. Thus, when the second oil effluent pipe 149 for returning oil is provided in the first chamber 122, it can also be used for the lower liquid level sensing pipe, so that the number of piping parts can be reduced.

Figure 34A:
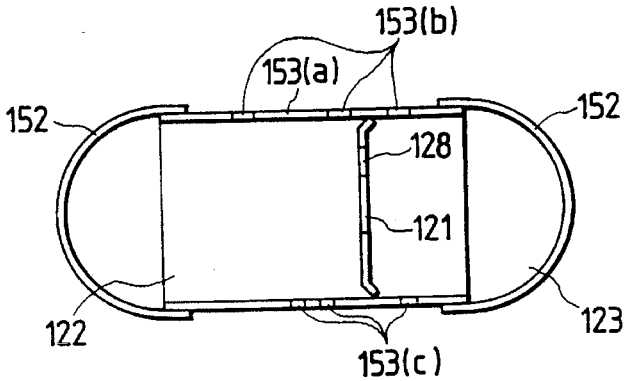
FIG. 34A is a sectional side view of an accumulator of a 3-piece structure according to embodiment 27 of the invention before pipes such as a refrigerant inflow pipe are connected.
Figure 34B:
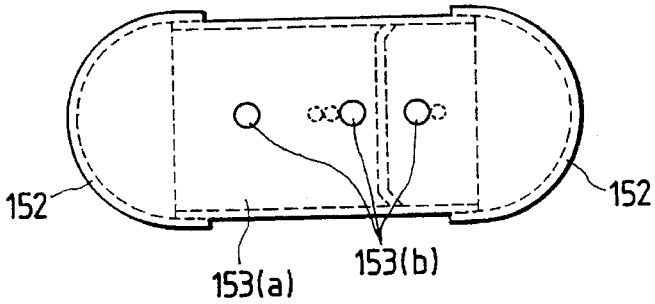
FIG. 34B is a top view of the accumulator shown in FIG. 34A.

Embodiment 27:

FIG. 34A is a sectional side view of an accumulator of a 3-piece structure according to a twenty-seventh embodiment of the invention before pipes such as a refrigerant inflow pipe are connected. FIG. 34B is a top view of the accumulator. In FIGS. 34A and 34B, numeral 153 (a) is an accumulator vessel barrel, numeral 153 (b) is holes made in a row on the top of the accumulator vessel barrel 153 (a), through which pipes such as the refrigerant inflow pipe are inserted, numeral 153 (c) is holes made in a row on the bottom of the accumulator vessel barrel 153 (a), through which pipes such as an oil effluent pipe are inserted, numeral 121 is a partition plate, numeral 128 is a communication hole made in the partition plate 121, numeral 122 is a first chamber, numeral 123 is a second chamber, and numeral 152 is end plates joined to both sides of the accumulator vessel barrel 153 (a) by welding, etc.

In the embodiment, the holes made in the accumulator are all collected at the accumulator vessel barrel 153 (a) and arranged in a row on the top and bottom of the accumulator vessel barrel 153 (a), so that assembly and joining can be performed from one direction and the machining time can be reduced.

Figure 35:
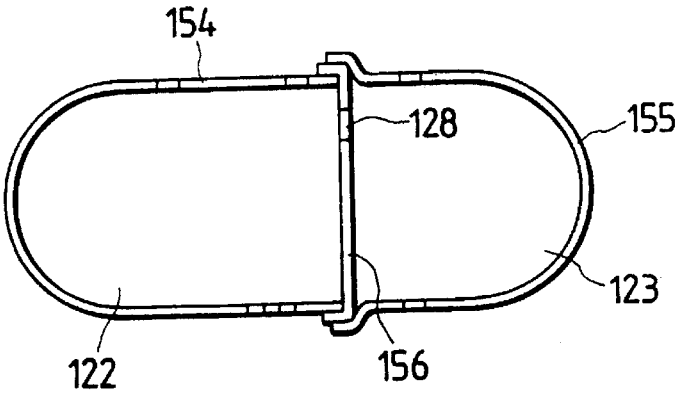
FIG. 35 is a sectional side view and a top view showing the 2-piece structure of an accumulator of a refrigerant circuit outdoor machine according to embodiment 28 of the invention.

Embodiment 28:

FIG. 35 is a sectional side view of an accumulator of a 2-piece structure according to a twenty-eighth embodiment of the invention before pipes such as a refrigerant inflow pipe are connected. In the figure, numeral 154 is a first accumulator vessel to which deep drawing is applied by pressing, etc., for defining a first chamber 122, numeral 156 is a partition plate fitted into the outer surface of the first accumulator vessel 154, numeral 128 is a communication hole made in the partition plate 156, and numeral 155 is a second accumulator vessel for defining a second chamber 123 and fitted into the outer surface of the partition plate 156.

In the embodiment, the accumulator has two pieces joined at a single position. To weld the two pieces, welding is easily positioned and automated. At welding, weld sputter is hard to enter the vessel, and they can be joined at a time depending on the welding condition. Further, to join them by brazing, they are joined at one position and can be brazed at a time. Thus, the assembly and joining work time can be reduced.

Figure 36:
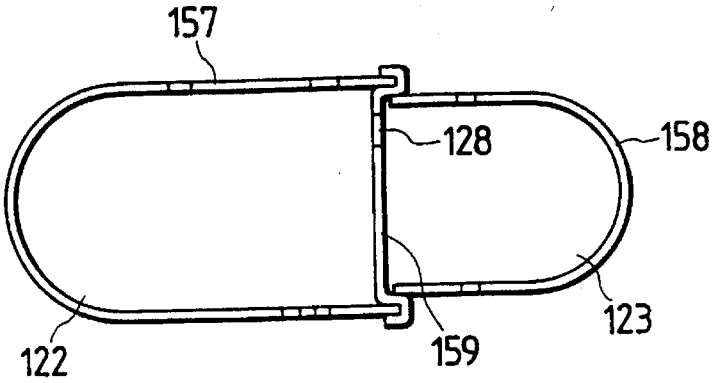
FIG. 36 is a sectional side view showing the 2-piece structure of an accumulator of a refrigerant circuit outdoor machine according to embodiment 29 of the invention.

Embodiment 29:

FIG. 36 is a sectional side view of an accumulator of a 2-piece structure according to a twenty-ninth embodiment of the invention before pipes such as a refrigerant inflow pipe are connected. In the figure, numeral 157 is a first accumulator vessel to which deep drawing is applied by pressing, etc., for defining a first chamber 122, numeral 159 is a partition plate fitted into the first accumulator vessel 157 so as to catch ends of the first accumulator vessel 157, numeral 128 is a communication hole made in the partition plate 159, and numeral 158 is a second accumulator vessel for defining a second chamber 123 and fitted into the inner surface of the partition plate 159.

Also in the embodiment, the accumulator has two pieces joined at a single position. To weld the two pieces, welding is easily positioned and automated. Particularly, at welding, weld sputter can be prevented from entering the vessel. Further, to join them by brazing, they are joined at one position and can be brazed at a time and more reliably than in the twenty-ninth embodiment. Thus, the assembly and joining work time can be reduced.

Figure 37:
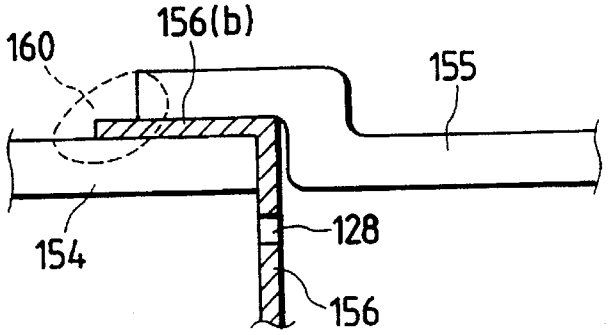
FIG. 37 is a sectional side view showing the joint structure of an accumulator of a refrigerant circuit outdoor machine according to embodiment 30 of the invention.

Embodiment 30:

FIG. 37 is a sectional side view showing the joint structure of the joined part of an accumulator according to a thirtieth embodiment of the invention. In the figure, numeral 154 is a first accumulator vessel to which deep drawing is applied by pressing, etc., for defining a first chamber 122, numeral 156 is a partition plate having a flange fitted into the outer surface of the first accumulator vessel 154, numeral 128 is a communication hole made in the partition plate 156, and numeral 155 is a second accumulator vessel for defining a second chamber 123 and fitted into the outer surface of the partition plate 156. The engagement part, the part of fitting the second accumulator vessel 155 into the partition plate 156 is shorter then the flange of the partition plate 156. Thus, the three parts are fitted and welded at the same time, forming a weld bead 160 as indicated by the dotted line.

In the embodiment, the accumulator has two pieces joined at a single position. The flange of the partition plate 156 is overlaid on the outer surface of the first accumulator vessel 154 and the engagement part of the inner surface of the second accumulator vessel 155 shorter than the flange of the partition plate 156 is overlaid on the outer face for welding. Therefore, in addition to the effect of the thirtieth embodiment, they can be welded at a time and the partition plate 156 separating the accumulator into the first and second chambers 122 and 123 can also be made reliably air tight. To make the part reliably air tight, the flange of the partition plate 156 needs to be longer than the engagement part of the second accumulator vessel 155 (in the embodiment 1 to 2 mm). Thus, welding is easily positioned and automated, at welding, weld sputter is hard to enter the vessel, and the assembly and joining work time can be reduced.

Figure 38:
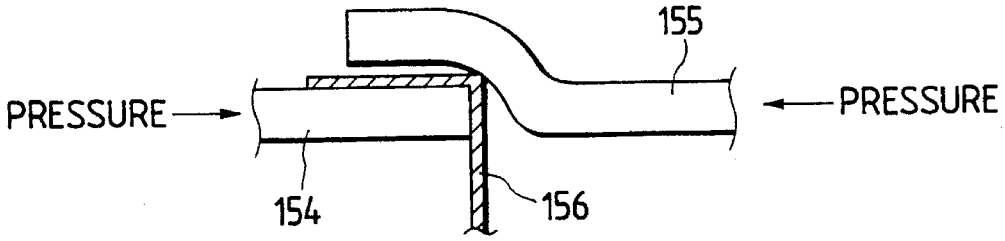
FIG. 38 is a sectional side view showing the joint structure of an accumulator of a refrigerant circuit outdoor machine according to embodiment 31 of the invention.

Embodiment 31:

FIG. 38 is a sectional side view showing the joint structure of the joined part for illustrating a method of manufacturing an accumulator according to a thirty-first embodiment of the invention. Components identical with or similar to those of the thirty-first embodiment previously described with reference to FIG. 37 are denoted by the same reference numerals in FIG. 38 and will not be discussed again. In the manufacturing method of the invention, when three parts are welded at the same time, a flange of a partition plate 156 and a second accumulator vessel 155 are fitted into a first accumulator vessel 154 and while the first and second accumulator vessels 154 and 156 are pressed against each other, they are welded. Alternatively, with either the first accumulator vessel 154 or the second accumulator vessel 155 fixed with a jig or the like, the unfixed accumulator vessel is pressurized and while pressure is left, it is fixed and tacked by spot welding, etc., before welding, or with one side fixed, direct welding is performed without tacking while the other is pressurized.

According to the embodiment, in addition to a similar effect to that of the thirtieth embodiment, weld sputter can be reliably prevented from entering the vessel because the partition plate 156 engages the first and second accumulator vessels 154 and 155 at welding.

Figure 39:
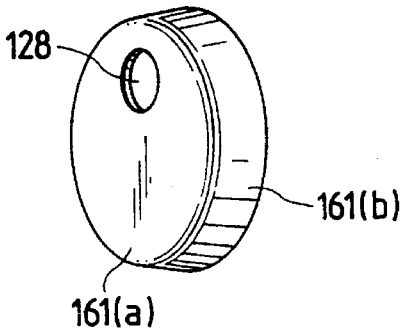
FIG. 39 is a side view of a partition plate of an accumulator according to embodiment 32 of the invention.

Embodiment 32:

FIG. 39 is a perspective view of a partition plate of an accumulator according to a thirty-second embodiment of the invention, wherein numeral 161 (a) is a partition plate for partitioning off an accumulator into first and second chambers and numeral 161 (b) is a flange disposed at the partition plate 161 (a) and formed like a taper having a tip whose outer diameter is larger than the inner diameter of the accumulator vessel, the outer diameter of the flat part of the partition plate being smaller than the inner diameter of the accumulator vessel. Numeral 128 is a communication hole made in the partition plate 161 (a).

Figure 40:
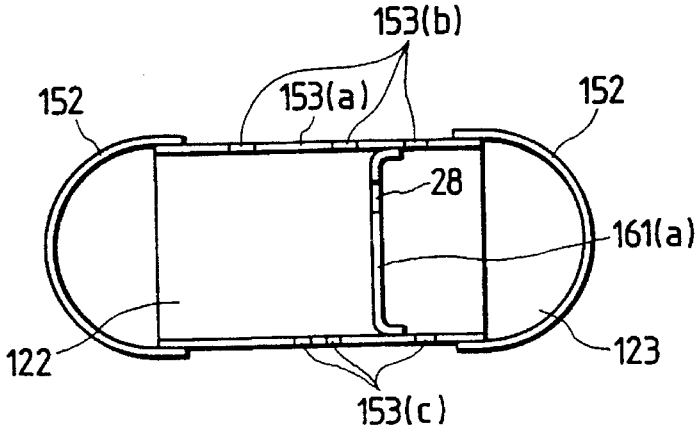
FIG. 40 is a sectional side view showing an example in which the partition plate of embodiment 32 of the invention is built in an accumulator of a refrigerant circuit outdoor machine.

FIG. 40 is a sectional view showing an example in which the partition plate 161 (a) is built in a transversely mounted 3-piece accumulator. Components identical with or similar to those of the twenty-seventh embodiment previously described with reference to FIGS. 34A and 34B are denoted by the same reference numerals in FIG. 40 and will not be discussed again. Thus, the partition plate 161 (a) having the tapered flange 161 (b) is pushed into an accumulator vessel barrel 153 (a). At the time, the partition plate 161 (a) is placed along the accumulator vessel barrel 153 (a) reliably by a spring force of the tapered flange 161 (b) of the partition plate 161 (a), and is held at the position at which the pushing is stopped. After this, the tapered flange 161 (b) of the partition plate 161 (a) is joined to the accumulator vessel barrel 153 (a) by TIG welding, etc.

According to the embodiment, the partition plate 161 (a) is easily positioned and comparatively easily welded without giving large distortion to the partition plate 161 (a) although it is thin.

The refrigerant inflow speed reduction unit, the wall transfer unit for causing refrigerant to flow along the wall, and liquid refrigerant transfer prevention unit for preventing liquid refrigerant in the first chamber from transferring to the second chamber described in the above-mentioned embodiments are properly combined, whereby an accumulator having the functions and effects of the unit can be provided as a matter of course.

We have discussed the invention by taking refrigerant circuit outdoor machine accumulators as examples, but the invention can be applied not only to the outdoor accumulators, but also to a wide range of the refrigerant circuit accumulators.

What is claimed is:

1. An air conditioning system comprising:

a refrigerant circuit including a compressor, an oil separator, a condenser, an expansion device, an evaporator, a first accumulator, and a second accumulator which are connected in order by piping;

a first oil return bypass for connecting said oil separator and at least one of said first accumulator and said second accumulator; and a second oil return bypass for connecting said compressor and at least one of said first accumulator and said second accumulator.

2. An air conditioning system as claimed in claim 1, wherein said first oil return bypass connects said oil separator and a connection pipe between said first and second accumulators; and said second oil return bypass connects said first accumulator and a connection pipe between said second accumulator and said compressor.

3. An air conditioning system as claimed in claim 1, further comprising a third oil return bypass for connecting said second accumulator and a connection pipe between said first accumulator and said compressor;

wherein said first oil return bypass connects said oil separator and said second accumulator; and said second oil return bypass connects said first accumulator and a connection pipe between said first accumulator and said compressor.

4. An air conditioning system as claimed in claim 1, wherein said first accumulator and said second accumulator are a first chamber and a second chamber of an accumulator respectively which in divided into said first and second chambers by a partition plate.

5. An air conditioning system as claimed in claim 4, further comprising an inflow pipe for connecting said compressor and said first chamber of said accumulator;

wherein said first oil return bypass connects said oil separator and said second chamber; and said second oil return bypass connects said accumulator and a connection pipe between said accumulator and said compressor.

6. An air conditioning system as claimed in claim 4, further comprising an inflow pipe for connecting said compressor and said first chamber of said accumulator; and a third oil return pipe for connecting said second chamber and a connection pipe between said accumulator and said compressor;

wherein said first oil return pipe connects said oil return pipe and said second chamber; and said second oil return pipe connects said first chamber and a connection pipe between said accumulator and said compressor.

7. An air conditioning system as claimed in claim 6, further comprising: a first flow quantity controller whose opening is variable, said first flow quantity controller being disposed on said second oil return bypass.

8. An air conditioning system as claimed in claim 7, further comprising means for detecting an operation capacity of said compressor, and a first opening controller for controlling an opening degree of said first flow quantity controller in response to the detected compressor operation capacity.

9. An air conditioning system as claimed in claim 7, further comprising means for detecting a liquid level in said first chamber of said accumulator, and a second opening controller for controlling the opening degree of said first flow quantity controller in response to the detected liquid level in said first chamber of said accumulator.

10. An air conditioning system as claimed in claim 7, further comprising means for storing relationship data between a previously found liquid level in said first chamber of said accumulator and an operation mode of said refrigerant circuit, means for determining the operation mode during operation, and a third opening controller for controlling the opening degree of said first flow quantity controller based on the operation mode determined by said operation mode determination means and the relationship data stored in said storage means.

11. An air conditioning system as claimed in claim 7, further comprising means for detecting a temperature of gas discharged from said compressor, and a fourth opening controller for controlling the opening degree of said first flow quantity controller in response to the detected discharged gas temperature.

12. An air conditioning system as claimed in claim 7, further comprising means for counting the operation time from starting of said compressor, and a fifth opening controller for controlling the opening degree of said first flow quantity controller so as to make the opening smaller than a predetermined opening until the counted operation time reaches a predetermined time.

13. An air conditioning system as claimed in claim 7, further comprising a second flow quantity controller being disposed on said second oil return bypass in parallel with said first flow quantity controller.

14. An air conditioning system as claimed in claim 13, further comprising a third flow quantity controller being disposed on said third oil return bypass for always providing a constant flow path.

15. An air conditioning system as claimed in claim 14, further comprising a mechanism for preventing liquid accumulated in said first chamber of said accumulator from flowing into said second chamber via said third oil return bypass from said second oil return bypass.

16. An air conditioning system as claimed in claim 15, wherein said inflow prevention mechanism is a check valve being disposed on said third oil return bypass in series with said third flow quantity controller for allowing a flow only in a direction toward said compressor.

17. An air conditioning system as claimed in claim 15, wherein said second flow quantity controller comprises a solenoid valve that can be fully closed.

18. An air conditioning system as claimed in claim 15, wherein said second flow quantity controller comprises at least one of an orifice and capillary, which is disposed at a position higher than the highest liquid level in said first chamber of said accumulator.

19. An air conditioning system as claimed in claim 4, wherein one accumulator-side end of the connection pipe for connecting said accumulator and said compressor is derived from said first chamber of said accumulator.

20. An air conditioning system as claimed in claim 5, wherein one accumulator-side end of the connection pipe for connecting said accumulator and said compressor is derived from said first chamber of said accumulator.

21. An air conditioning system as claimed in claim 6, wherein one accumulator-side end of the connection pipe for connecting said accumulator and said compressor is derived from said first chamber of said accumulator.

22. An air conditioning system as claimed in claim 13, wherein one accumulator-side end of the connection pipe for connecting said accumulator and said compressor is derived from said first chamber of said accumulator.

23. An accumulator used with a refrigerant circuit including a compressor, an oil separator, a condenser, a expansion device, an evaporator, and an accumulator connected by piping, said accumulator comprising:

a partition plate provided in a vessel of said accumulator to separate said vessel into first and second chambers;

a communication hole provided at a top of said partition plate;

a refrigerant inflow pipe disposed in said first chamber;

a refrigerant effluent pipe disposed in at least one of said first and second chambers; and an oil effluent pipe and an oil inflow pipe which are disposed in said second chamber.

24. An accumulator as claimed in claim 23, wherein said refrigerant effluent pipe in said first chamber is positioned between said refrigerant inflow pipe and said partition plate, and said refrigerant inflow pipe in said first chamber and said oil inflow pipe in said second chamber are projected so that their tips in said chambers are placed lower than and lower end of said communication hole;

further wherein said refrigerant inflow pipe is spaced from said refrigerant effluent pipe more than a diameter of said refrigerant inflow pipe, and a lower end of said refrigerant effluent pipe is disposed near an inner wall of said accumulator vessel.

25. An accumulator as claimed in claim 23, wherein said refrigerant inflow pipe has means for reducing a inflow speed of refrigerant.

26. An accumulator as claimed in claim 25, wherein said refrigerant inflow speed reduction means has a form of slantingly cutting said refrigerant inflow pipe tip.

27. An accumulator as claimed in claim 23, wherein said refrigerant inflow pipe includes wall transfer means for causing a refrigerant flowing into said accumulator to flow along a wall of said accumulator.

28. An accumulator as claimed in claim 27, wherein a top end portion of said refrigerant inflow pipe in said first chamber of said accumulator has a tip bent in a direction opposed to said partition plate and said top end portion is pointed toward a shoulder of said accumulator which is a joint part of a dome and barrel of said vessel.

29. An accumulator as claimed in claim 23, further comprising liquid refrigerant transfer prevention means for preventing a liquid refrigerant in said first chamber from being transferred to said second chamber, wherein said liquid refrigerant transfer prevention means is projected toward said first chamber of said accumulator and is provided below said communication hole of said partition plate.

30. An accumulator as claimed in claim 29, wherein said liquid refrigerant transfer prevention means is formed by notching said communication hole of said partition plate in said accumulator vessel and bending a notch toward said first chamber.

31. An accumulator as claimed in claim 29, further comprising an upper liquid level sensing pipe for sensing whether a refrigerant exists, which is fitted to said liquid refrigerant transfer prevention means.

32. An accumulator as claimed in claim 31, wherein said upper liquid level sensing pipe in said first chamber is disposed lower than said communication hole.

33. An accumulator as claimed in claim 23, further comprising a temperature sensor provided in said oil effluent pipe in said second chamber, wherein whether or not a refrigerant flows into said first chamber from said second chamber is sensed by determination of a temperature sensed by said temperature sensor.

34. An accumulator as claimed in claim 23, further comprising a second oil effluent pipe which is disposed at a bottom of said first chamber and is communicated with said compressor; and a liquid level sensing circuit for sensing whether a refrigerant exists, which is fitted to said second oil effluent pipe in said first chamber.

35. An accumulator as claimed in claim 23, wherein comprising three pieces of end plates which are both ends and a barrel, wherein holes for necessary refrigerant pipes are all collected at said barrel.

36. An accumulator as claimed in claim 23, wherein said accumulator is transversely mounted, further wherein said accumulator vessel is divided into two parts at said partition plate separating said accumulator into said first and second chambers, and said vessels and partition plate are set to the same weld position.

37. An accumulator as claimed in claim 36, wherein said partition plate is provided with a flange, said flange of said partition plate is overlaid on an outer surface of said first accumulator vessel, and an engagement part of said second accumulator vessel shorter than said flange is overlaid on an outer surface, forming a weld part for welding said three parts at the same time.

38. An accumulator as claimed in claim 23, wherein said accumulator is transversely mounted, further wherein said partition plate separating said accumulator into said first and second chambers has a tapered flange on its outer peripheral surface, and an outer diameter of said flange tip is larger than an inner diameter of said accumulator vessel and an outer diameter of a flat part of said partition plate is smaller than the inner diameter of said accumulator vessel.

* * * * *